US011674257B2

(12) United States Patent
Jung et al.

(10) Patent No.: US 11,674,257 B2
(45) Date of Patent: Jun. 13, 2023

(54) LAUNDRY TREATING APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 17/132,892

(22) Filed: Dec. 23, 2020

(65) Prior Publication Data

US 2021/0189630 A1 Jun. 24, 2021

(30) Foreign Application Priority Data

Dec. 24, 2019 (KR) ..... 10-2019-0174254

(51) Int. Cl.
*D06F 39/02* (2006.01)
*D06F 23/04* (2006.01)

(52) U.S. Cl.
CPC ..... *D06F 39/022* (2013.01); *D06F 23/04* (2013.01)

(58) Field of Classification Search
CPC ..... D06F 39/022; D06F 39/02; D06F 39/028; D06F 39/088; D06F 33/37; D06F 2105/42; D06F 23/04; A47L 15/4418; A47L 15/0055; A47L 15/0084; A47L 15/44
USPC ..... 68/12.18
See application file for complete search history.

(56) References Cited

U.S. PATENT DOCUMENTS 8,382,913 B2 * 2/2013 Classen ..... A47L 15/0055 68/17 R
2005/0229652 A1 * 10/2005 Kim ..... D06F 39/028 68/237
2017/0107656 A1 * 4/2017 Kim ..... D06F 39/022
2017/0159227 A1 6/2017 Jung et al.
2020/0040510 A1 * 2/2020 Lv ..... D06F 39/02

FOREIGN PATENT DOCUMENTS

| | | |
|---|---|---|
| CN | 107447423 | 12/2017 |
| CN | 108729133 | 11/2018 |
| CN | 109183360 | 1/2019 |
| WO | WO2015199417 | 12/2015 |
| WO | WO2018219149 | 12/2018 |

OTHER PUBLICATIONS

EP Extended European Search Report in European Appln. No. 20216886.0, dated Mar. 18, 2021, 8 pages.
Office Action in Chinese Appln. No. 202011549067.2, dated Sep. 22, 2022, 11 pages (with English translation).

* cited by examiner

*Primary Examiner* — David G Cormier
*Assistant Examiner* — Thomas Bucci
(74) *Attorney, Agent, or Firm* — Fish & Richardson P.C.

(57) ABSTRACT

Disclosed is a laundry treating apparatus. The laundry treating apparatus includes a cabinet, a tub, a drum, and a detergent reservoir. The detergent reservoir has a storage space defined therein for storing the detergent therein, and has a ventilation hole defined in a top face thereof for communicating the storage space with the outside. The laundry treating apparatus further includes a flow inhibiting wall including a plurality of inhibiting walls arranged in the storage space and protruding from an inner face of the detergent reservoir to inhibit flow of the detergent towards the ventilation hole.

18 Claims, 48 Drawing Sheets

LAUNDRY TREATING APPARATUS

CROSS-REFERENCE TO RELATED APPLICATION

This application claims the benefit of Korean Patent Application No. 10-2019-0174254, filed on Dec. 24, 2019, which is hereby incorporated by reference as if fully set forth herein.

TECHNICAL FIELD

The present disclosure relates to a laundry treating apparatus, more particularly to, a laundry treating apparatus having a detergent feeder.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

The detergent feeder has a detergent feeding function to improve a washing effect. Herein, the detergent means a substance, such as fabric detergent, fabric softener, fabric bleach, and the like, that enhances the washing effect. Detergent in a powder form and detergent in a liquid form may be used as the detergent.

Related literature KR 10-2018-0090003 A1 discloses a detergent feeder included in a laundry treating apparatus. The laundry treating apparatus includes a detergent reservoir that is used while being retracted into the detergent feeder and extended to the outside of the detergent feeder.

However, in the process in which the detergent reservoir retracts into the cabinet of the laundry treating apparatus and extends to the outside of the cabinet, the detergent inside the detergent reservoir may flow. It is an important task to prevent leakage of the detergent to the outside of the detergent reservoir or remove unnecessary vibrations resulted from such flow.

SUMMARY

Embodiments of the present disclosure intend to provide a laundry treating apparatus that may improve ease of use by effectively preventing leakage of detergent stored in a detergent reservoir.

In addition, embodiments of the present disclosure are to provide a laundry treating apparatus that may effectively suppress formation of unnecessary flow in the detergent inside the detergent reservoir.

An embodiment of the present disclosure intends to propose a structure for reducing an amount of leakage of detergent through a ventilation hole of a detergent reservoir when storage is moved. For example, an embodiment of the present disclosure intends to propose a shape of the ventilation hole for reducing an exposed area of the ventilation hole.

In addition, a rib-shaped flow inhibiting wall may be added to a casing and a cap member of the detergent reservoir to inhibit flow of detergent inside the detergent reservoir. Accordingly, an embodiment of the present disclosure may effectively suppress the leakage of the detergent to improve ease of use and maintainability, and prevent unnecessary flow of the detergent to improve usability.

Particular implementations of the present disclosure provide a laundry treating apparatus that includes a cabinet, a tub, a drum, and a detergent reservoir. The cabinet defines a detergent opening. The tub is received in the cabinet. The drum is configured to rotate inside the tub. The detergent reservoir is configured to receive a detergent and inserted into the cabinet through the detergent opening. The detergent reservoir may define a storage space configured to receive the detergent, and further define a ventilation hole configured to allow fluid communication between the storage space and an exterior of the detergent reservoir. The laundry treating apparatus may include a plurality of walls protruding from an inner face of the detergent reservoir and disposed in the storage space. The plurality of walls may be configured to restrict flow of the detergent toward the ventilation hole.

In some implementations, the apparatus can optionally include one or more of the following features. The detergent opening may be defined at a front face of the cabinet. The detergent reservoir may be configured to be retracted into the detergent opening along a first direction that extends between the front face of the cabinet and a rear face of the cabinet opposite to the front face of the cabinet. The ventilation hole may be located at a first side of the detergent reservoir that is positioned closer to the front face of the cabinet than to the rear face of the cabinet. The plurality of the walls may include a first wall located farther from the front face of the cabinet than the ventilation hole is. The first wall may extend in a second direction transverse to the first direction. The ventilation hole may be located between a first face of the detergent reservoir and the first wall. The first face of the detergent reservoir may be positioned closer to the front face of the cabinet than the first wall is. The ventilation hole may be located closer to a first side face of the detergent reservoir than to a second side face of the detergent reservoir opposite to the first side face of the detergent reservoir. The plurality of the walls may include a second wall located at an opposite side of the first side face with respect to the ventilation hole. The second wall may extend in the first direction. The ventilation hole may be located between the first side face of the detergent reservoir and the second wall. The first wall may be connected to the first side face of the detergent reservoir. The second wall may be connected to the first face of the detergent reservoir. The first wall and the second wall may define an edge region in which the ventilation hole is located in the storage space. Respective ends of the first wall and the second inhibiting wall that face each other may be spaced apart from each other and define a gap therebetween that is configured to allow fluid communication between the edge region and a remaining region of the storage space of the detergent reservoir. The plurality of the walls may include a third wall that is positioned closer to the ventilation hole than the first wall and the second wall are and that faces the gap of the edge region. The third wall may include an extended face extending from the first side face of the detergent reservoir. The extended face may be extended in parallel with the first wall or the second wall. The first wall and the second wall may protrude from a bottom face of the detergent reservoir. Respective top ends of the first wall and the second wall may be spaced apart from a top face of the detergent reservoir. The third wall may protrude from the top face of the detergent reservoir. A bottom end of the third wall may be spaced from the bottom face of the detergent reservoir. The detergent reservoir may include a detergent injection portion, a detergent discharge portion, and a connection portion. The detergent injection portion may be located at the front side of the detergent reservoir and defining the ventilation hole. The detergent discharge portion may be located at a rear side of the detergent reservoir and constructed to discharge the detergent. The rear side of the detergent reservoir may be opposite to the first side of the detergent reservoir along the first direction. The connection portion may connect the detergent injection portion with the detergent discharge portion. The storage space may extend from the detergent injection portion to the detergent discharge portion through the connection portion. The plurality of the walls may include a fourth wall that is disposed at the detergent injection portion and faces the connection portion. The fourth wall may extend in the second direction. The plurality of the walls may include a fifth wall disposed at the connection portion. The fifth wall may extend in the second direction. The fifth wall may be connected to a side face of the connection portion, and extend toward the rear face of the cabinet in a direction away from the side face of the connection portion. The ventilation hole may have a lower end that faces the storage space and an upper end that faces the exterior of the detergent reservoir. A central portion of the ventilation hole between the lower end and the upper end of the ventilation hole may extend in parallel with a top face of the detergent reservoir. The upper end of the ventilation hole may extend from a first side of the central portion, and the lower end of the ventilation hole may extend from a second side of the central portion that is opposite to the first side of the central portion. The central portion of the ventilation hole may extend along a lateral direction of the detergent reservoir. The central portion, the upper end, and the lower end of the ventilation hole may define an overlapping region that exposes the storage space to the exterior of the detergent reservoir. The ventilation hole may be defined at a top surface of the detergent reservoir. The detergent opening may be defined at a front face of the cabinet. The detergent reservoir may be configured to be retracted into the detergent opening along a first direction that extends between the front face of the cabinet and a rear face of the cabinet opposite to the front face of the cabinet. The ventilation hole may be located at a front side of the detergent reservoir that is positioned closer to the front face of the cabinet than to the rear face of the cabinet. The plurality of the walls may include a first wall located at a rear of the ventilation hole. The first wall may extend in a second direction transverse to the first direction. The ventilation hole may be located between a front face of the detergent reservoir and the first wall. The ventilation hole may be located closer to a first side face of the detergent reservoir than to a second side face of the detergent reservoir opposite to the first side face of the detergent reservoir. The plurality of the walls may include a second wall located at an opposite side of the first side face with respect to the ventilation hole. The second wall may extend in the first direction. The ventilation hole may be located between the first side face of the detergent reservoir and the second wall. The first wall may be connected to the first side face of the detergent reservoir and the second wall may be connected to the front face of the detergent reservoir. The first wall and the second wall may define an edge region in which the ventilation hole is located in the storage space. The fifth wall may be connected to a side face of the connection portion, and extend rearward in a direction away from the side face of the connection portion.

One aspect of the present disclosure proposes a laundry treating apparatus including a cabinet having a detergent opening defined therein, a tub installed inside the cabinet, a drum rotatably installed inside the tub, and a detergent reservoir for storing detergent therein, wherein the detergent reservoir is inserted into the cabinet through the detergent opening.

The detergent reservoir has a storage space defined therein for storing the detergent therein, and has a ventilation hole defined in a top face thereof for communicating the storage space with the outside, and the laundry treating apparatus further includes a flow inhibiting wall including a plurality of inhibiting walls arranged in the storage space and protruding from an inner face of the detergent reservoir to inhibit flow of the detergent towards the ventilation hole.

In one implementation, the detergent opening may be defined in a front face of the cabinet, the detergent reservoir may be retracted into the detergent opening along a front and rear direction, the ventilation hole may be located at a front side of the detergent reservoir, the flow inhibiting wall may include a first inhibiting wall located at the rear of the ventilation hole, the first inhibiting wall may extend in a direction transverse to the front and rear direction, and the ventilation hole may be located between a front face of the detergent reservoir and the first inhibiting wall.

In one implementation, the ventilation hole may be located adjacent to one of both side faces of the detergent reservoir, the flow inhibiting wall may further include a second inhibiting wall located on an opposite side of said one side face around the ventilation hole, the second inhibiting wall may extend in a direction transverse to a lateral direction, and the ventilation hole may be located between said one side face of the detergent reservoir and the second inhibiting wall.

In one implementation, the first inhibiting wall may be connected to said one side face of the detergent reservoir and the second inhibiting wall is connected to the front face of the detergent reservoir, so that an edge region where the ventilation hole is located in the storage space may be partitioned from remaining regions.

In one implementation, respective sides of the first inhibiting wall and the second inhibiting wall facing each other may be spaced apart from each other, so that an open face of the edge region may be defined.

In one implementation, the flow inhibiting wall may further include a third inhibiting wall positioned closer to the ventilation hole than the first inhibiting wall and the second inhibiting wall, and having one face disposed to face the open face.

In one implementation, the third inhibiting wall may include an extended face extending from said one face, and the extended face may be extended in parallel with the first inhibiting wall or the second inhibiting wall.

In one implementation, the first inhibiting wall and the second inhibiting wall may protrude from a bottom face of the detergent reservoir, and respective protruded ends of the first inhibiting wall and the second inhibiting wall may be spaced apart from the top face of the detergent reservoir, and the third inhibiting wall may protrude from the top face of the detergent reservoir, and a protruded end of the third inhibiting wall may be spaced from the bottom face of the detergent reservoir.

In one implementation, the detergent reservoir may include a detergent injection portion located at a front portion of the detergent reservoir and having the ventilation hole defined therein, a detergent discharge portion located at a rear portion of the detergent reservoir, and constructed to discharge the detergent, and a connection portion for connecting the detergent injection portion and the detergent discharge portion with each other, the storage space may extend from the detergent injection portion to the detergent discharge portion through the connection portion, the flow inhibiting wall may further include a fourth inhibiting wall disposed in the detergent injection portion to face the connection portion, and the fourth inhibiting wall may extend in the direction transverse to the front and rear direction.

In one implementation, the flow inhibiting wall may further include a fifth inhibiting wall disposed in the connection portion, and the fifth inhibiting wall may extend in the direction transverse to the front and rear direction.

In one implementation, the fifth inhibiting wall may be connected to a side face of the connection portion, and may extend rearward in a direction further away from the side face of the connection portion.

In one implementation, a central portion of the ventilation hole between a lower end facing the storage space and an upper end facing an exterior of the detergent reservoir may extend in parallel with the top face of the detergent reservoir.

In one implementation, the upper end of the ventilation hole may extend from one side of the central portion, and the lower end of the ventilation hole may extend from the other side of the central portion. In one implementation, the central portion of the ventilation hole may extend along a lateral direction of the detergent reservoir.

In one implementation, an overlapping region for exposing the storage space to the outside therethrough may be defined in the ventilation hole as a portion of the upper end and a portion of the lower end overlap each other along the lateral direction.

Embodiments of the present disclosure may provide the laundry treating apparatus that may improve the ease of use by effectively preventing the leakage of the detergent stored in the detergent reservoir.

In addition, embodiments of the present disclosure may provide the laundry treating apparatus that may effectively suppress the formation of the unnecessary flow in the detergent inside the detergent reservoir.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION

Figure 1:
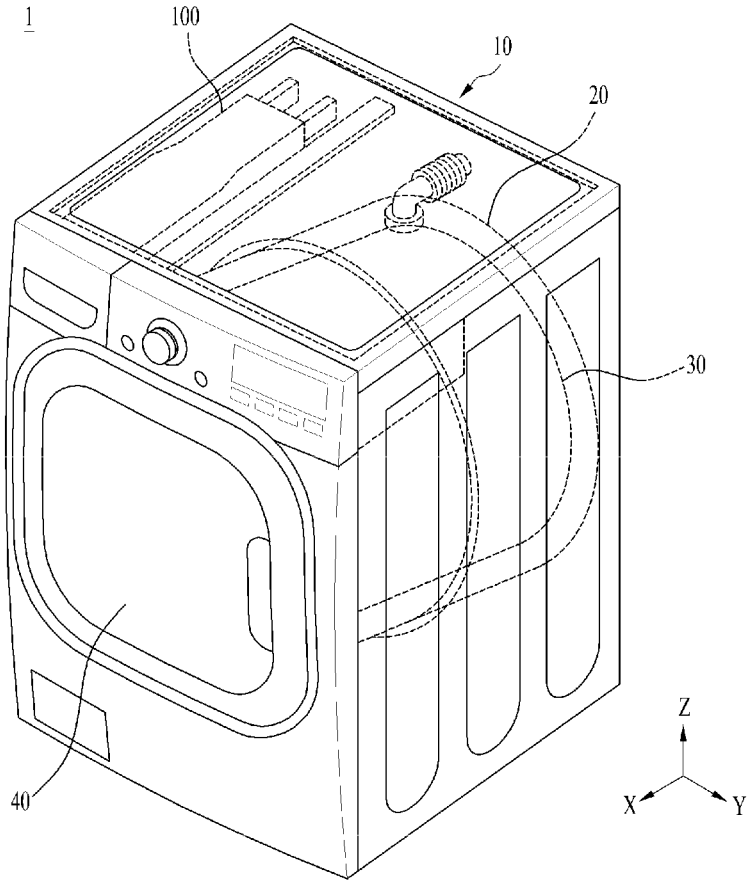
FIG. 1 is a perspective view illustrating a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
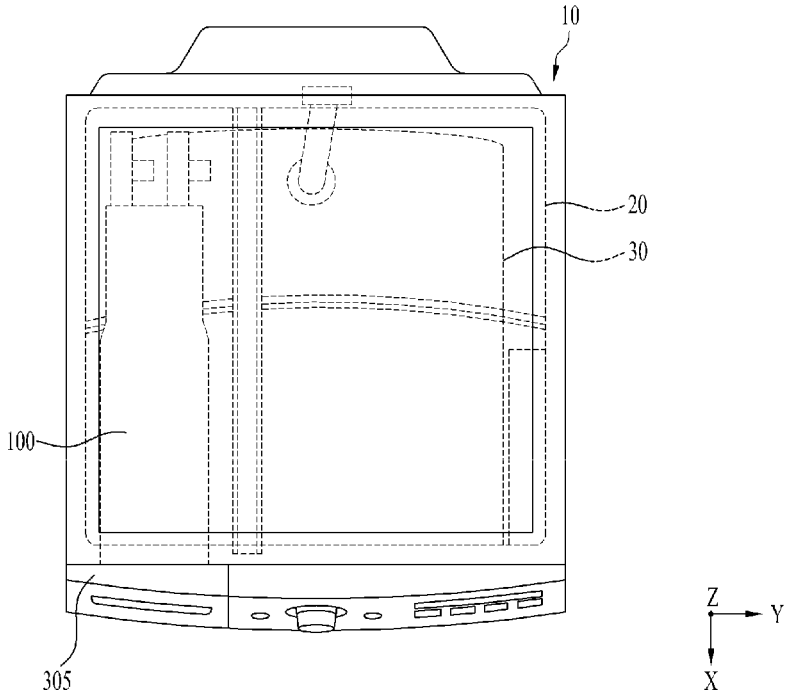
FIG. 2 is a top view of a laundry treating apparatus according to an embodiment of the present disclosure.
Figure 3:
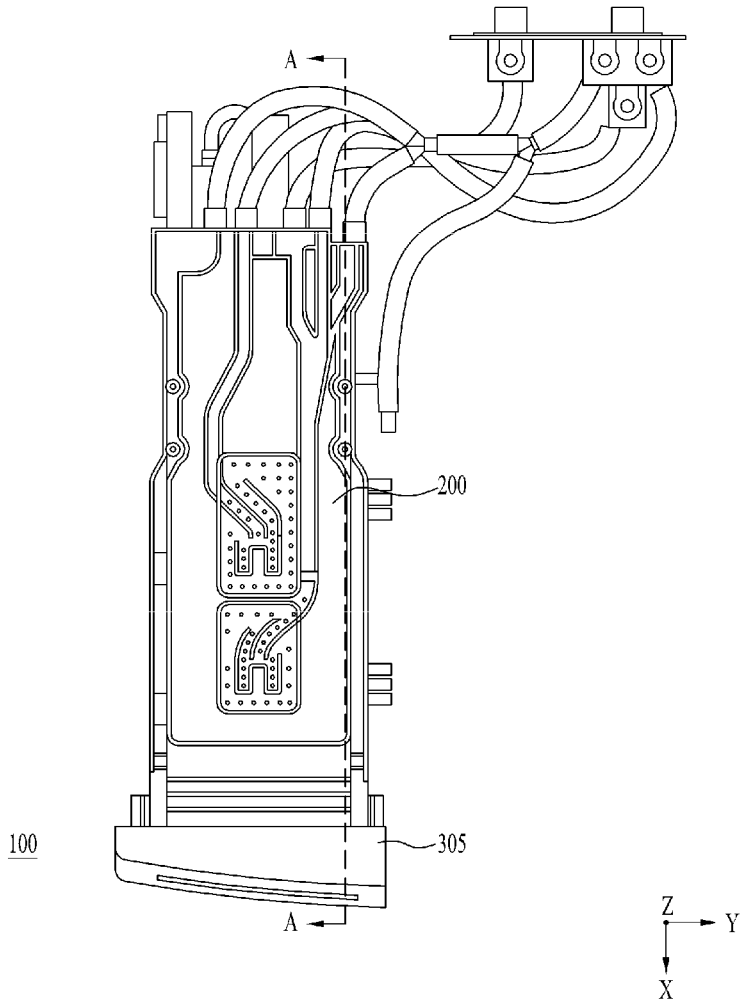
FIG. 3 is a top view of a detergent feeder of a laundry treating apparatus according to an embodiment of the present disclosure.

FIG. 1 is a perspective view illustrating a laundry treating apparatus 1 according to an embodiment of the present disclosure, FIG. 2 is a view of the laundry treating apparatus 1 viewed from above, and FIG. 3 is a top view of a detergent feeder 100 of the laundry treating apparatus 1 according to an embodiment of the present disclosure.

Referring to FIGS. 1 to 3, the laundry treating apparatus 1 according to an embodiment of the present disclosure includes a cabinet 10 having a detergent opening 15 defined in a front face thereof, a tub 20 installed inside the cabinet 10, a drum 30 rotatably installed inside the tub 20, and a detergent feeder 100 installed in the detergent opening 15.

The laundry treating apparatus 1 may include a washing machine in which a cloth is inserted into a washing tank to be washed, rinsed, dehydrated, and the like, a dryer in which a wet cloth is inserted to be dried, or the like.

The laundry treating apparatuses 1 may be classified into a top loading type laundry treating apparatus and a front loading type laundry treating apparatus. FIG. 1 illustrates the front loading type laundry treating apparatus 1, but this is only for convenience of description. Because the present disclosure is not applied only to front loading type washing machines, the present disclosure may be applicable to top loading type washing machines.

As shown in FIG. 1, the laundry treating apparatus 1 may have the cabinet 10 forming an appearance of the laundry treating apparatus 1, and a manipulation unit having a display that receives various control commands from a user and displays information on an operating state. The laundry treating apparatus 1 may include a door 40 installed on the front face of the cabinet 10 and pivotably disposed to allow laundry to enter and exit.

The cabinet 10 forms the appearance of the laundry treating apparatus 1. A space in which various components constituting the laundry treating apparatus 1 may be accommodated may be defined inside the cabinet 10. The drum 30 for accommodating therein the laundry inserted through the door 40 may be installed inside the cabinet 10.

Specifically, the tub 20 containing wash water therein and the drum 30 that is rotatably disposed inside the tub 20 to accommodate the laundry therein may be arranged inside the cabinet 10. A balancer for compensating for eccentricity caused by the rotation may be installed on one side of the drum 30.

The manipulation unit may include various keys for manipulating the operating state of the laundry treating apparatus 1 and the display for displaying the operating state of the laundry treating apparatus 1. The door 40 may contain a transparent member such as tempered glass and the like such that an interior of the cabinet 10 or the drum 30 may be visually identified.

In one example, in an embodiment of the present disclosure, the laundry treating apparatus 1 may have the detergent opening 15 defined in a front face thereof, and the detergent feeder 100 may be disposed inside the detergent opening 15.

A position of the detergent opening 15 may be various, and FIG. 1 illustrates a state in which the detergent opening 15 is defined in parallel with the manipulation unit in a lateral direction Y.

The detergent feeder 100 may be installed in the detergent opening 15 that may be defined at one side of an upper portion of the cabinet 10. The detergent feeder 100 may include storage 300 capable of storing detergent therein. FIG. 3 is the top view of the detergent feeder 100.

The detergent feeder 100 serves to automatically feed the detergent stored in the storage 300 to an interior of the drum 30 during the washing operation. The detergent refers to a substance that may improve a washing effect of the laundry, which may include liquid fabric detergent and liquid fabric softener.

Figure 4:
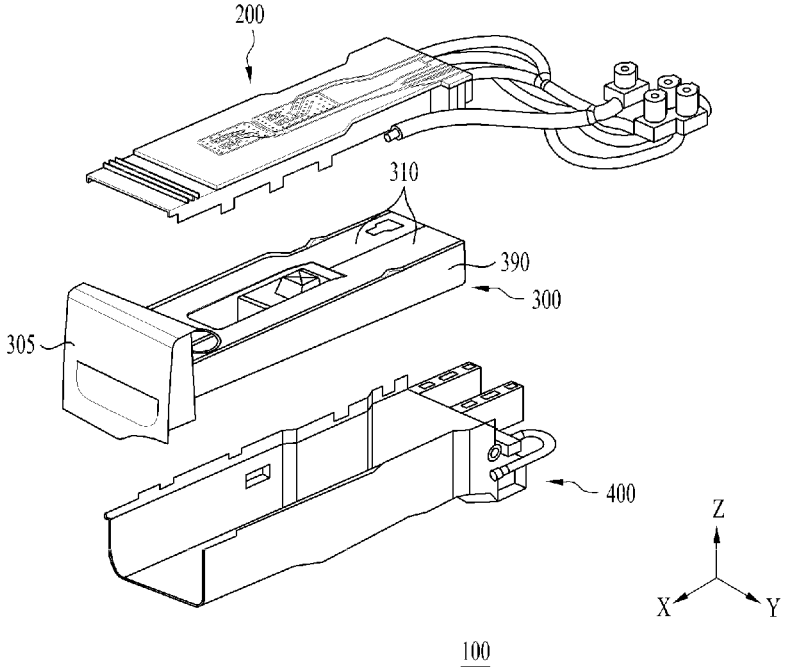
FIG. 4 is an exploded view of a detergent feeder in an embodiment of the present disclosure.

FIG. 4 illustrates a state in which the detergent feeder 100 is disassembled. The detergent feeder 100 may include a dispenser 200, the storage 300, and a feeder casing 400 from above as shown in FIG. 4.

The detergent may be stored in the storage 300. The storage 300 may be inserted into the detergent opening 15 along a front and rear direction X and may include a front handle 305, a storage frame 390, and a detergent reservoir 310 seated in the storage frame 390.

In the present disclosure, the front and the rear may be defined based on the detergent opening 15. For example, it may be understood that a direction from the detergent opening 15 toward the outside of the cabinet 10 is a forward direction and a direction from the detergent opening 15 toward an interior of the cabinet 10 is a rearward direction. That is, even when the door 40 and the detergent opening 15 are arranged on different faces of the cabinet 10, the front and the rear may be defined around the detergent opening 15.

Figure 5:
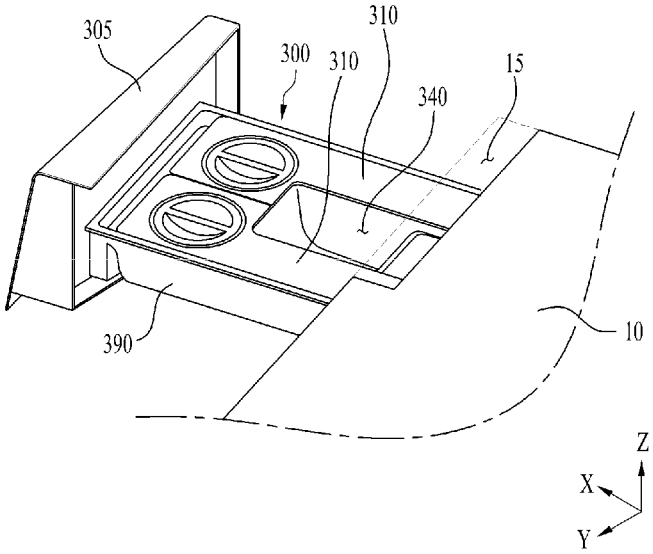
FIG. 5 is a view illustrating a state in which storage is extended from a laundry treating apparatus in an embodiment of the present disclosure.

In one example, FIG. 5 illustrates a view of the storage 300 extended from the detergent opening 15 viewed from the outside of the cabinet 10.

When the user grips and then pulls the handle 305 disposed on a front face of the storage 300, the storage 300 in a state of being retracted into the detergent opening 15 slides forward from a state of being stacked with the dispenser 200 and the feeder casing 400, so that the storage 300 may be extended outward of the cabinet 10 or outward of the detergent opening 15. Similarly, when the user pushes the handle 305 rearward, the storage 300 may slide and be inserted into the detergent opening 15.

Figure 6:
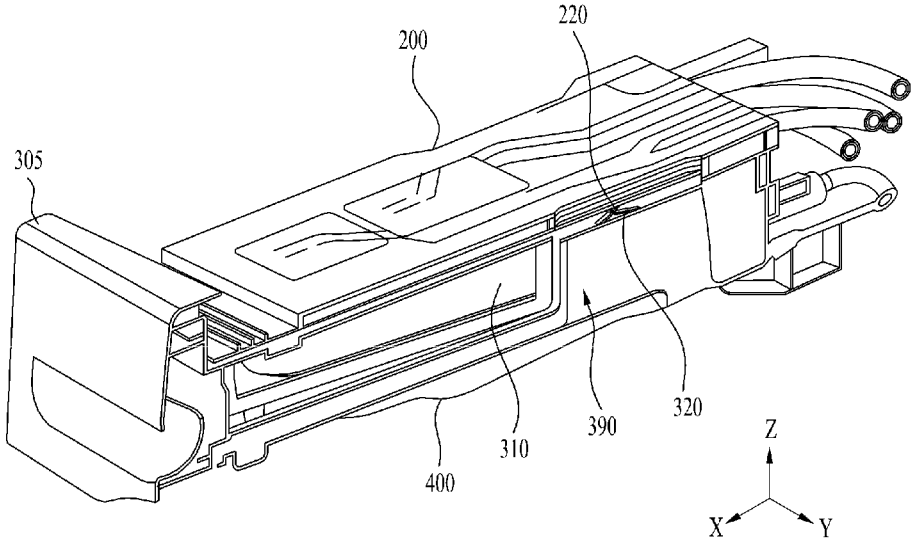
FIG. 6 illustrates a state of a detergent feeder in FIG. 3 being cut along a line A-A.

In one example, FIG. 6 illustrates a state of the detergent feeder 100 in FIG. 3 being cut along a line A-A. Referring to FIG. 6, an embodiment of the present disclosure may include a fixing portion disposed inside the cabinet 10 and disposed to face one face extending in the front and rear direction X of the storage 300 retracted into the detergent opening 15.

In addition, an embodiment of the present disclosure may include an engaging protrusion 320 disposed on said one face of the storage 300 and protruding toward the fixing portion, and an engaging elastic portion 220 disposed in the fixing portion, protruding toward said one face of the storage 300, and positioned in parallel with the engaging protrusion 320 along the front and rear direction X to be pressed and elastically deformed by the engaging protrusion 320 in the retraction process of the storage 300.

At least a portion of the engaging elastic portion 220 may be detachably coupled to the fixing portion.

Specifically, the fixing portion may be disposed inside the cabinet 10 and disposed to face said one face of the storage 300 extending in the front and rear direction X. FIG. 6 illustrates a state in which a bottom face of the fixing portion is disposed to face a top face of the storage 300.

In the present disclosure, the fixing portion may face one of the top face and both side faces of the storage 300, and may be the feeder casing 400 or a separate component. However, in an embodiment of the present disclosure, the fixing portion may correspond to the dispenser 200 of the detergent feeder 100 capable of feeding water to the storage 300 during the washing process.

Unlike the storage 300, the fixing portion may not be retracted or extended through the detergent opening 15 in the state of being installed inside the cabinet 10, and may be disposed in a state of being fixed at a specific position.

Figure 7:
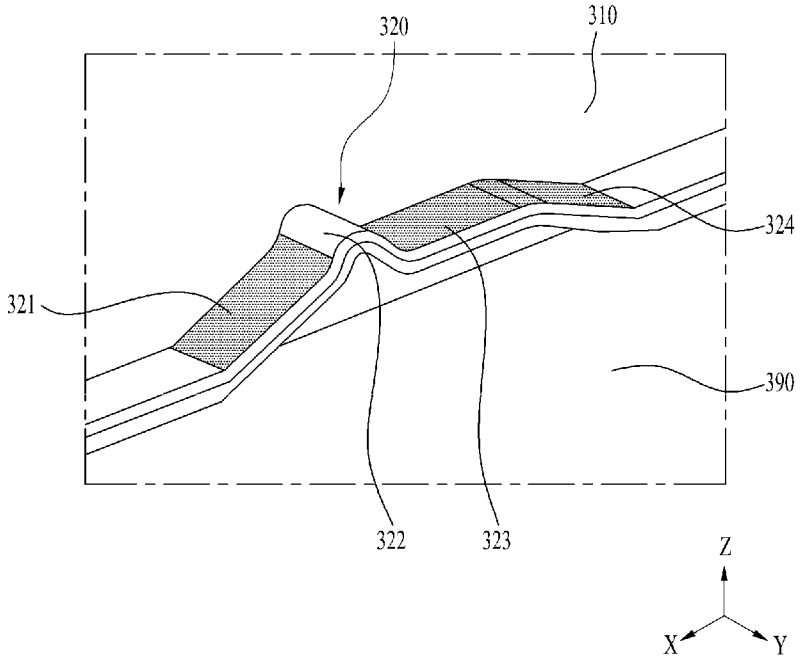
FIG. 7 is a view illustrating an engaging protrusion in an embodiment of the present disclosure.

The engaging protrusion 320 may be disposed on said one face of the storage 300 facing the fixing portion, for example, the dispenser 200. FIG. 6 illustrates a state in which the engaging protrusion 320 is disposed on the top face of the storage 300, and FIG. 7 illustrates an enlarged view of the engaging protrusion 320.

The engaging protrusion 320 may protrude from said one face of the storage 300 toward the fixing portion. A protrusion shape of the engaging protrusion 320 may vary as needed.

The engaging elastic portion 220 may be disposed in the fixing portion. The engaging elastic portion 220 may be formed to protrude from the fixing portion toward the storage 300. For example, as shown in FIG. 6, the engaging elastic portion 220 may protrude downward from the dispenser 200. FIG. 7 illustrates the engaging elastic portion 220 disposed in the fixing portion.

The engaging elastic portion 220 may be constructed such that at least a portion thereof overlaps the engaging protrusion 320 along the front and rear direction X. That is, the engaging elastic portion 220 may be positioned in parallel with the engaging protrusion 320 along the front and rear direction X. Accordingly, at least a portion of the engaging elastic portion 220 may be pressed and elastically deformed by the engaging protrusion 320 during the retraction or the extension process of the storage 300.

A protrusion shape of the engaging elastic portion 220 may be varied as needed. For example, the engaging protrusion 320 and the engaging elastic portion 220 may have a shape in which a center thereof protrude such that a front side and a rear side thereof have a gentle slope.

The engaging elastic portion 220 may be made of a material having elasticity and capable of being deformed and restored, and may have higher elasticity than the engaging protrusion 320. In addition, the engaging elastic portion 220 may have higher elasticity than a material of the fixing portion.

Figure 9:
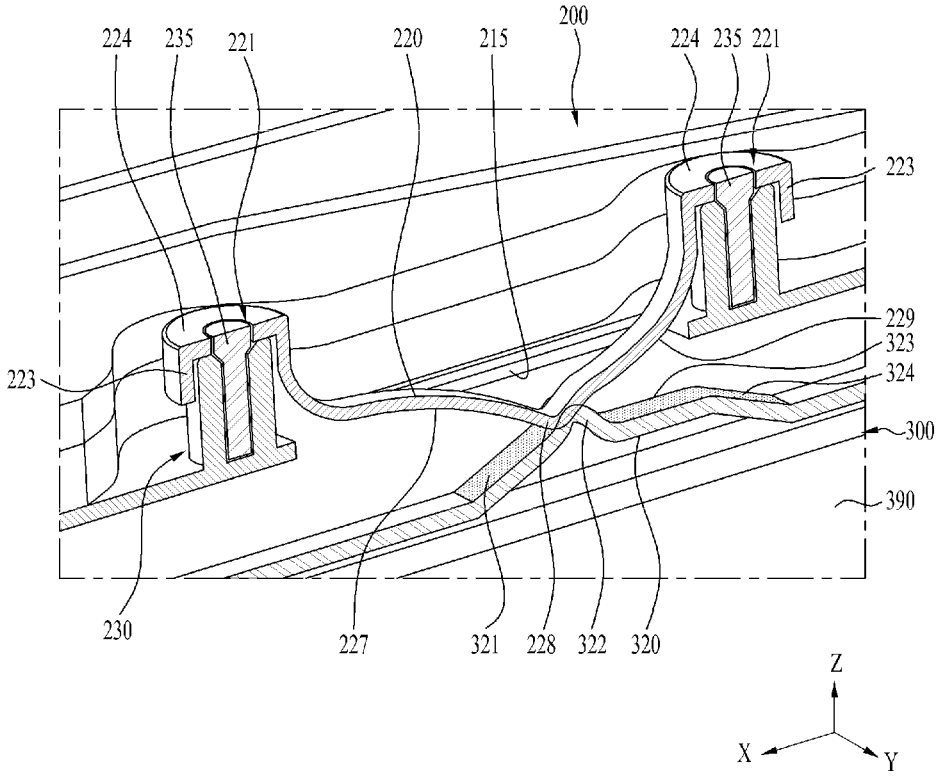
FIG. 9 is a perspective view illustrating an engaging protrusion and an engaging elastic portion in a state in which storage is retracted in an embodiment of the present disclosure.

FIG. 9 is a view illustrating the engaging elastic portion 220 and the engaging protrusion 320 in a state in which the storage 300 is retracted into the detergent opening 15 according to an embodiment of the present disclosure. Referring to FIG. 9, at least a portion, for example, a portion including an end protruding downward of the engaging elastic portion 220 may be disposed to overlap the engaging protrusion 320 along the front and rear direction X or a retraction direction of the storage 300.

Figure 10:
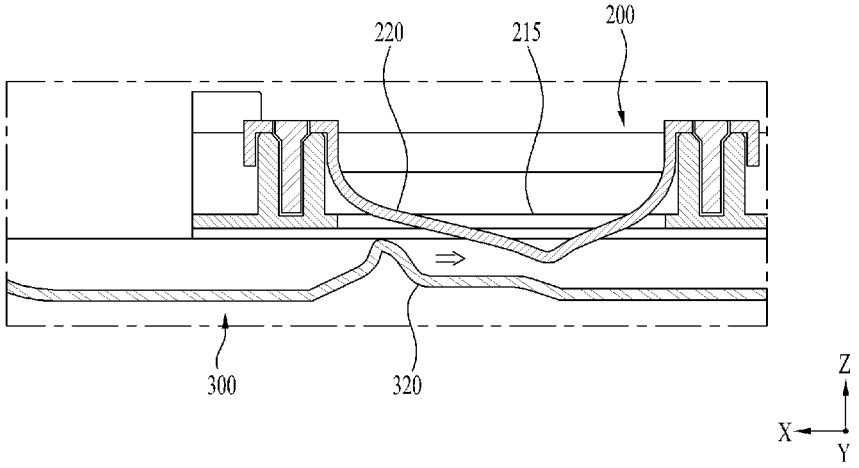
FIG. 10 is a cross-sectional view illustrating a state in which storage is extended in an embodiment of the present disclosure.

FIG. 10 illustrates a state in which the storage 300 in the extended state slides into the detergent opening 15. Referring to FIG. 10, the storage 300 may be extended such that the engaging protrusion 320 is positioned forward of the engaging elastic portion 220, and the engaging protrusion 320 may move rearward toward the engaging elastic portion 220 in the retraction process.

Figure 11:
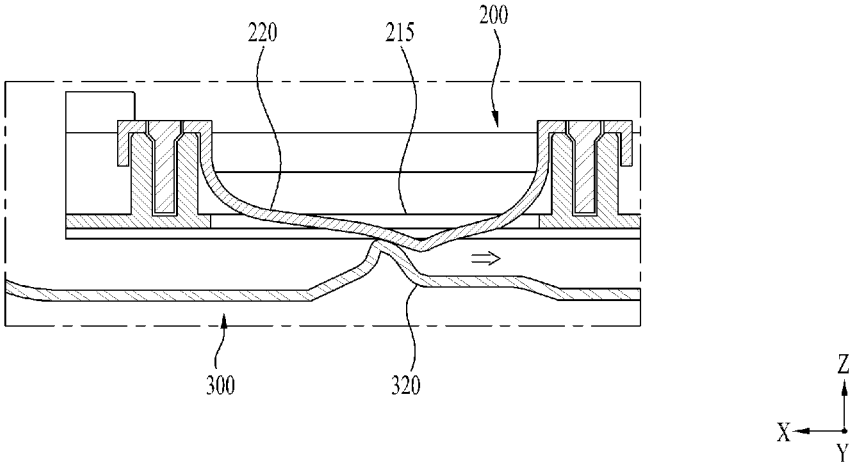
FIG. 11 is a cross-sectional view illustrating a state in which storage is retracted in FIG. 10.

A state in which the engaging protrusion 320 in FIG. 10 is moved rearward and overlaps the engaging elastic portion 220 in the vertical direction Z is illustrated in FIG. 11.

Referring to FIG. 11, in the retraction process of the storage 300, the engaging protrusion 320 may be moved rearward while passing the engaging elastic portion 220. That is, the engaging elastic portion 220 may be positioned so as to overlap with the engaging protrusion 320 in the vertical direction Z, and may be pressed and deformed by the engaging protrusion 320.

The engaging elastic portion 220 pressed by the engaging protrusion 320 may be deformed such that a protruding height thereof decreases, and accordingly, the engaging protrusion 320 may pass the engaging elastic portion 220 and move rearward.

Figure 12:
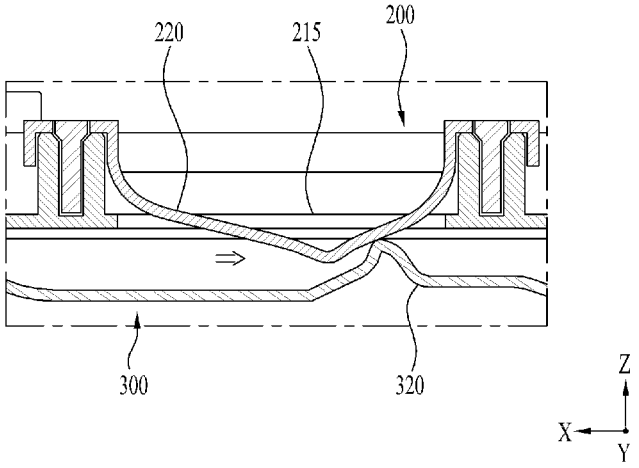
FIG. 12 is a cross-sectional view illustrating a state in which a retraction process of storage in FIG. 11 is terminated.

A state in which the engaging protrusion 320 shown in FIG. 11 is moved rearward and passes the engaging elastic portion 220 and the storage 300 is completely retracted into the detergent opening 15 is shown in FIG. 12.

Referring to FIG. 12, when the storage 300 is completely retracted into the detergent opening 15, the engaging protrusion 320 passes the engaging elastic portion 220 and is positioned rearward of the engaging elastic portion 220. The engaging elastic portion 220 may be elastically restored when the engaging protrusion 320 passes the engaging elastic portion 220 after the engaging elastic portion 220 is deformed by the engaging protrusion 320.

The user may extend the storage 300 from the detergent opening 15 using the handle 305 and inject the detergent into the storage 300. The storage 300 in which the detergent is stored may be retracted by sliding back into the detergent opening 15. In this connection, the user may be aware of the retraction situation of the storage 300 through a contact relationship between the engaging protrusion 320 and the engaging elastic portion 220.

For example, the user may recognize the contact between the engaging protrusion 320 and the engaging elastic portion 220 in the process of gripping the handle 305 and pushing the storage 300 rearward, and a predetermined pressure may be transmitted to the user. As the engaging protrusion 320 passes the engaging elastic portion 220, the force transmitted to the user may be reduced, and the user may identify that the storage 300 has completely reached the retracted state.

In addition, as a restoring force of the engaging elastic portion 220 is transmitted to the engaging protrusion 320, the engaging elastic portion 220 may provide a moving force to the engaging protrusion 320 such that the storage 300 moved such that the engaging protrusion 320 passes the engaging elastic portion 220 is retracted to a distal end of the detergent opening 15.

Accordingly, the user feels a certain reaction force. Then, the reaction force disappears while retracting the storage 300 into the detergent opening 15 and rather a force that induces the retraction is provided, so that the user may feel a soft and stable retraction feeling of the storage 300.

In one example, referring again to FIG. 8, in the laundry treating apparatus 1 according to an embodiment of the present disclosure, at least the portion of the engaging elastic portion 220 may be detachably coupled to the fixing portion.

Specifically, the engaging elastic portion 220 may be manufactured separately from the fixing portion, and at least the portion thereof may be constructed to be coupled to the fixing portion. In this connection, the engaging elastic portion 220 may be coupled to the fixing portion to be detachable therefrom.

The engaging elastic portion 220 corresponds to an elastic body that is deformed by being pressed by the engaging protrusion 320 and restored. It may be advantageous that the engaging elastic portion 220 is made of a material that it is easier to deform than a material of the fixing portion and has excellent elasticity. An embodiment of the present disclosure may be advantageous because the engaging elastic portion 220 is manufactured separately from the fixing portion, so that the engaging elastic portion 220 may be manufactured using a material different from that of the fixing portion having high rigidity.

In addition, manufacturing of the fixing portion may include a heat-treatment process. In this case, the material of the fixing portion may decrease in elasticity and increase in rigidity after the heat-treatment. When the engaging elastic portion 220 is molded together with the fixing portion, the engaging elastic portion 220 may also decrease in the elasticity by the heat-treatment process.

That is, an embodiment of the present disclosure is advantageous in that a change in properties of the material resulted from a series of molding processes included in the manufacture of the fixing portion may be avoided as the engaging elastic portion 220 is manufactured separately from the fixing portion and is detachably coupled to the fixing portion.

In one example, in the state in which the storage 300 is retracted into the detergent opening 15, in the laundry treating apparatus 1 according to an embodiment of the present disclosure, a maximally protruded point 228 of the engaging elastic portion 220 may be positioned forwardly of a maximally protruded point 322 of the engaging protrusion 320 and the engaging elastic portion 220 may rearwardly support the engaging protrusion 320.

The maximum protrusion point 228 of the engaging elastic portion 220 refers to a point of the engaging elastic portion 220 protruding farthest from the fixing portion in the vertical direction Z, and the maximum protrusion point 322 of the engaging protrusion 320 refers to a point protruding farthest from the storage 300 in the vertical direction Z. The maximum protrusion point 322 of the engaging protrusion 320 is indicated in FIG. 7, and the maximum protrusion point 228 of the engaging elastic portion 220 is indicated in FIG. 9.

Referring to FIG. 7, in the engaging protrusion 320, a front pressing portion 321 inclined may be positioned in front of the maximally protruded point 322, a flat pressing portion 323 may be positioned at the rear of the maximally protruded point 322, and a rear pressing portion 324 may be positioned at the rear of the flat pressing portion 323.

In the retraction process of the storage 300, the engaging elastic portion 220 may be pressed by the rear pressing portion 324 of the engaging protrusion 320. Thereafter, as the maximally protruded point 228 of the engaging elastic portion 220 is supported on the flat pressing portion 323 of the engaging protrusion 320, the deformed state of the engaging elastic portion 220 may be maintained. Accordingly, the reaction force by the engaging elastic portion 220 may be provided stepwise in the retraction process of the storage 300.

When the maximally protruded point 322 of the engaging protrusion 320 passes the maximally protruded point 228 of the engaging elastic portion 220, while the front pressing portion 321 of the engaging protrusion 320 supports the engaging elastic portion 220, the engaging elastic portion 220 is gradually restored.

In one example, referring to FIG. 9, in the engaging elastic portion 220, a front inclined portion 227 may be positioned in front of the maximally protruded point 228, and a rear inclined portion 229 may be positioned at the rear of the maximally protruded point 228.

The front inclined portion 227 may extend rearward from a front end of the engaging elastic portion 220 and may become closer to the storage 300 as the front inclined portion 227 is further away from the front end. That is, the front inclined portion 227 may be formed to be inclined such that a protruding height thereof increases toward the maximally protruded point 228.

In one example, the rear inclined portion 229 may extend rearward from the front inclined portion 227, and may be constructed to move away from the storage 300 as a distance from the front inclined portion 227 increases. That is, the rear inclined portion 229 may be formed to be inclined such that a protruding height thereof decreases rearwardly from the maximally protruded point 228.

In the process in which the storage 300 is retracted into the detergent opening 15, the engaging protrusion 320 presses the front inclined portion 227 to elastically deform the engaging elastic portion 220. In the state in which the storage 300 is retracted into the detergent opening 15, the engaging protrusion 320 may be in contact with and supported by the rear inclined portion 229.

Figure 15:
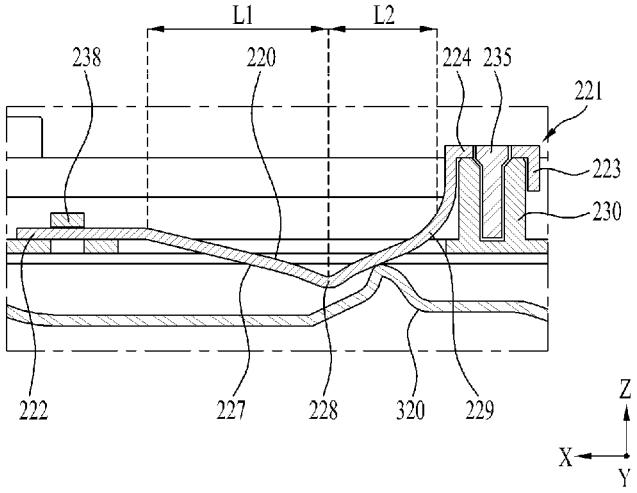
FIG. 15 is a cross-sectional view illustrating an engaging elastic portion and an engaging protrusion in FIG. 14.

In one example, the front inclined portion 227 may have a longer and smoother inclined face than the rear inclined portion 229. FIG. 15 illustrates a state in which a length L1 of the front inclined portion 227 is larger than a length L2 of the rear inclined portion 229.

Accordingly, the engaging elastic portion 220 may provide a reaction force of a relatively low increase rate to the engaging protrusion 320 in the retraction process of the storage 300 such that the retraction process is not disturbed, and provide a reaction force of a relatively high increase rate in the extension process of the storage 300 such that unnecessary extension of the storage 300 may be prevented.

In one example, referring to FIG. 12, when the storage 300 is completely retracted into the detergent opening 15, the maximally protruded point 322 of the engaging protrusion 320 may be positioned rearward of the maximally protruded point 228 of the engaging elastic portion 220, and the engaging elastic portion 220 may support the engaging protrusion 320 rearward.

That is, the engaging protrusion 320 may be pressed rearwardly by the engaging elastic portion 220, and accordingly, the retracted state of the storage 300 may be stably maintained. Further, when the user extends the storage 300, as the extension of the storage 300 starts, the reaction force caused by the engaging elastic portion 220 may be immediately recognized, so that the user may effectively recognize the extension situation of the storage 300 and may restrict the unnecessary extension of the storage 300.

Figure 8:
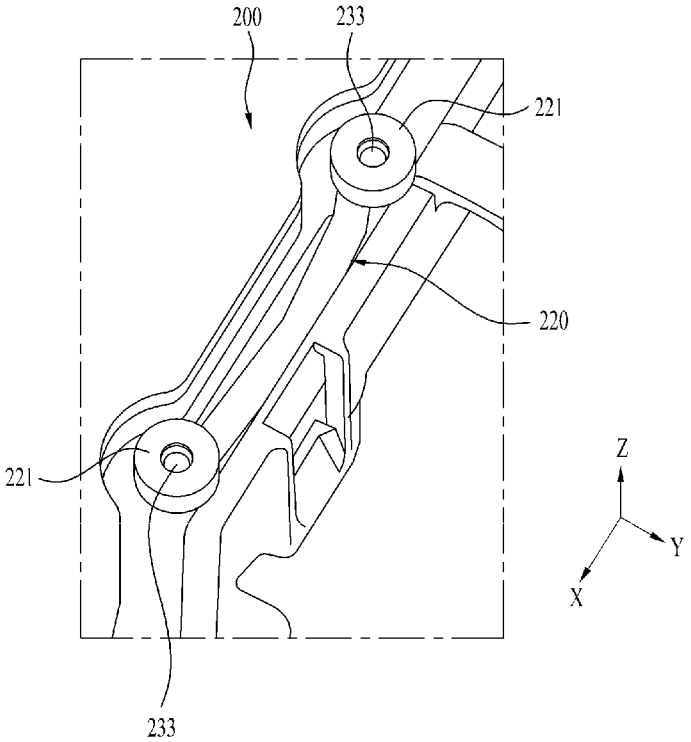
FIG. 8 is a view illustrating an engaging elastic portion in which caps are respectively formed at both ends in an embodiment of the present disclosure.

In one example, referring to FIGS. 8 to 9, in an embodiment of the present disclosure, the fixing portion has a through-hole 215 that opens toward said one face of the storage 300. A central portion of the engaging elastic portion 220 may pass through the through-hole 215 and protrude toward the storage 300.

A shape of the through-hole 215 may vary, and may penetrate the fixing portion. In the engaging elastic portion 220, at least one of a front end and a rear end may be coupled to and fixed to the fixing portion, and the central portion of the engaging elastic portion 220 may pass through the through-hole 215 and protrude toward said one face of the storage 300.

The maximally protruded point 228 of the engaging elastic portion 220 may be positioned at the central portion. As the central portion passes through the through-hole 215 and protrudes toward the storage 300, a protrusion distance of the engaging elastic portion 220 may be effectively increased such that the deformation and the restoration thereof are facilitated by the pressing of the engaging protrusion 320. FIGS. 10 to 12 illustrate a state in which the engaging elastic portion 220 protruding to pass through the through-hole 215 is pressed by the engaging protrusion 320 to be deformed and is restored.

For example, when the fixing portion corresponds to the dispenser 200 and when the engaging elastic portion 220 protrudes to pass through the through-hole 215 of the dispenser 200, compared to a case in which the engaging elastic portion 220 protrudes directly from a bottom face of the dispenser 200, a total protruding length of the engaging elastic portion 220 may be increased, which may be advantageous for the elastic deformation.

In one example, as shown in FIGS. 8 to 9, in an embodiment of the present disclosure, the front end and the rear end of the engaging elastic portion 220 may be positioned on an opposite side of the storage 300 with respect to the fixing portion, and the engaging elastic portion 220 may be bent such that the central portion extending from the front end and the rear end passes through the through-hole 215.

For example, the fixing portion may correspond to the dispenser 200, the engaging elastic portion 220 may extend in the front and rear direction X, the front end and the rear end of the engaging elastic portion 220 may be positioned on the top face of the dispenser 200, and the central portion of the engaging elastic portion 220 may pass through the through-hole 215 and may extend from the top face of the dispenser 200 toward the bottom face of the dispenser 200.

The engaging elastic portion 220 may be constructed such that a strap or a straight member is bent or curved. That is, the engaging elastic portion 220 has an empty space on an opposite side of a contact face with the engaging protrusion 320, so that the engaging elastic portion 220 may be easily deformed by the pressing of the engaging protrusion 320 and elastically restored.

In one example, referring to FIG. 9, in an embodiment of the present disclosure, a fastening groove 233 may be defined at least one of forward and rearward of the through-hole 215. The engaging elastic portion 220 may be positioned such that at least one of the front end and the rear end thereof overlaps the fastening groove 233, and may be penetrated by a fastening member 235, which is inserted into the fastening groove 233, and coupled to the fixing portion.

The fastening groove 233 may be defined to overlap the front end or the rear end of the engaging elastic portion 220 in the vertical direction Z as being defined at least one of forward and rearward of the through-hole 215. The fastening member 235 may couple the engaging elastic portion 220 with the fixing portion by penetrating an end of the engaging elastic portion 220 overlapping the fastening groove 233 and being inserted into the fastening groove 233. The fastening member 235 may have a length like a bolt or the like, may be inserted into the fastening groove 233, and may be easily coupled to and removed from the fastening groove 233.

In one example, as shown in FIG. 9, an embodiment of the present disclosure may further include a fastening portion 230 and a cap 221.

The fastening portion 230 may be disposed in the fixing portion and protrude along an insertion direction of the fastening member 235, and the fastening groove 233 may be defined at a center of the fastening portion 230. As the fastening groove 233 is defined in the fastening member 235 protruding from the fixing portion, a length of the fastening groove 233 into which the fastening member 235 may be inserted may be easily secured.

The cap 221 may be disposed on at least one of the front end and the rear end of the engaging elastic portion 220. That is, the cap 221 may be disposed at an end of the engaging elastic portion 220 overlapping the fastening groove 233.

The cap 221 may have a space defined therein, and an outer circumferential face 223 thereof may be disposed to surround an outer circumferential face of the fastening portion 230. That is, the fastening portion 230 may be coupled to be inserted into the cap 221.

In the cap 221 into which the fastening portion 230 is inserted, a top face 224 may be penetrated by the fastening member 235. Accordingly, as the fastening portion 230 protruding from the fixing portion is inserted into the cap 221 and the cap 221 is coupled with the fastening portion 230 by the fastening member 235, the cap 221 may have a stable coupling structure with the fastening portion 230.

In one example, as shown in FIGS. 8 to 9, in an embodiment of the present disclosure, the fastening grooves 233 may be respectively defined forward and rearward of the through-hole 215. The front end and the rear end of the engaging elastic portion 220 may be respectively coupled to the fastening grooves 233 that respectively overlap the front end and the rear end, so that positions of the front end and the rear end of the engaging elastic portion 220 may be fixed. Further, the central portion may be elastically deformed. Accordingly, the engaging elastic portion 220 may be implemented in a stable structure as the front end and the rear end are fixed despite the elastic deformation of the central portion.

Figure 13:
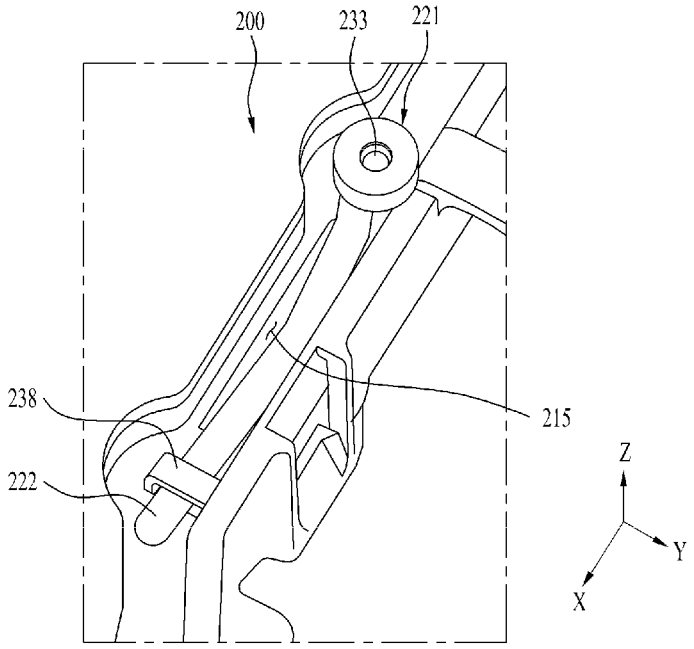
FIG. 13 is a view illustrating that a cap is formed at a rear end and an engaging elastic portion is slid at a front end in an embodiment of the present disclosure.
Figure 14:
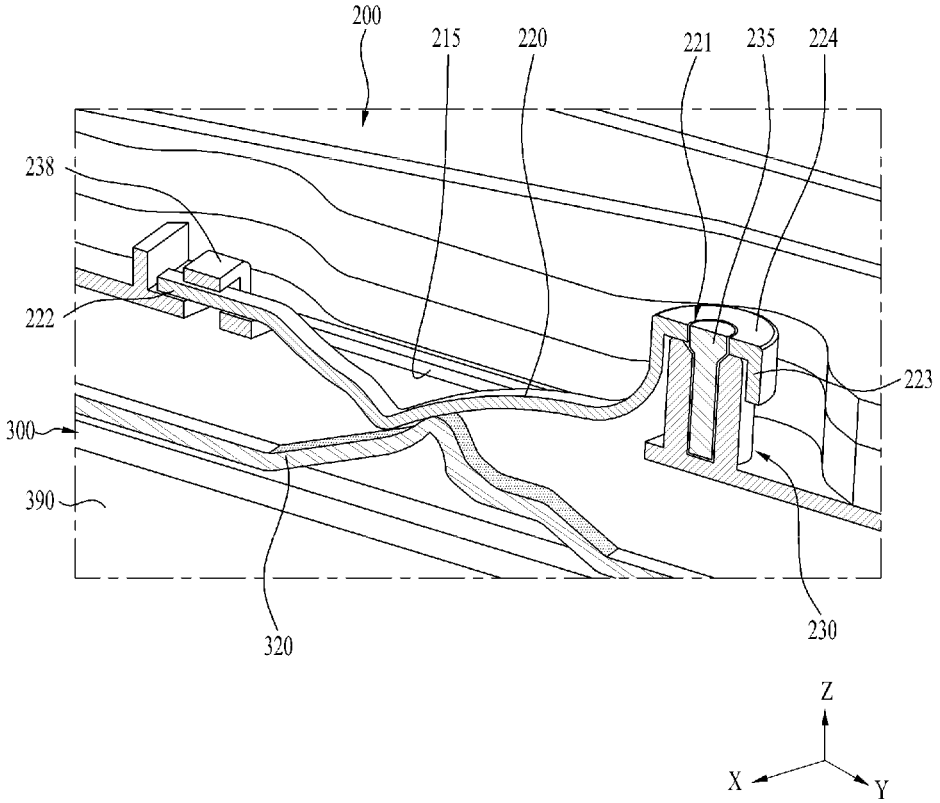
FIG. 14 is a perspective view illustrating an engaging elastic portion and an engaging protrusion in FIG. 13.

In one example, FIG. 13 illustrates a state in which the front end of the engaging elastic portion 220 is constructed to be slidable and the cap 221 is formed at the rear end of the engaging elastic portion 220. FIG. 14 illustrates the engaging elastic portion 220 in FIG. 13 and the engaging protrusion 320 together, and FIG. 15 illustrates a cross-sectional view of the engaging elastic portion 220 of FIG. 13.

As above, in an embodiment of the present disclosure, the engaging elastic portion 220 may be constructed such that one of the front end and the rear end is coupled to the fastening groove 233 and the other is slidable on the fixing portion.

When both the front end and the rear end of the engaging elastic portion 220 are fixed to the fixing portion, for example, the dispenser 200, coupling stability between the engaging elastic portion 220 and the fixing portion may be improved. As shown in FIG. 13, when one of the front end and the rear end is disposed to be slidable on the fixing portion, an amount of elastic deformation of the central portion may be increased.

That is, when the engaging elastic portion 220 is pressed and deformed by the engaging protrusion 320, a slidable end of the engaging elastic portion 220 may be slid away from the center of the engaging elastic portion 220 to satisfy an amount of change in the protruding height of the engaging elastic portion 220.

Accordingly, in the engaging elastic portion 220 in which the front end or the rear end is constructed to be slidable, an amount of change in the protruding height allowed on the same through-hole 215 may be increased. Accordingly, a design restriction such as a height of the engaging protrusion 320 and the like may be reduced and the elastic force transmitted from the engaging elastic portion 220 to the engaging protrusion 320 may be reduced, so that smooth extension and retraction of the storage 300 may be induced.

In one example, in an embodiment of the present disclosure, the engaging elastic portion 220 may be constructed such that the rear end thereof is coupled to the fastening groove 233 and the front end thereof is slidable on the fixing portion.

Referring to FIGS. 13 to 15, in the engaging elastic portion 220, the rear end is fixed and the front end forms a sliding end 222 that is slidable. Accordingly, a larger amount of deformation may be accepted in the extension process than in the retraction process of the storage 300.

That is, the engaging elastic portion 220 may provide a greater reaction force to the engaging protrusion 320 in the extension process of the storage 300. Therefore, the reaction force is reduced in the retraction process of the storage 300, thereby providing a soft retraction feeling.

A fixing force for the retracted storage 300 may be increased and the larger amount of deformation by the engaging protrusion 320 may be accepted in the extension process, so that a large reaction force may be provided during the extension and the stable retracted state of the storage 300 may be maintained.

In one example, referring to FIGS. 13 to 15, an embodiment of the present disclosure may further include a guide 238.

The guide 238 may be disposed in the fixing portion, and a central portion thereof may be penetrated in the front and rear direction X by the front sliding end 222 of the engaging elastic portion 220.

The central portion of the guide 238 is penetrated by the sliding end 222 of the engaging elastic portion 220 along the front and rear direction X and the guide 238 fixes the position of the sliding end 222 while surrounding the sliding end 222 of the engaging elastic portion 220.

In an embodiment of the present disclosure, the front end of the engaging elastic portion 220 is constructed to be slidable and the front end of the engaging elastic portion 220 is not deviated from a sliding region using the guide 238, thereby securing structural stability.

Figure 16:
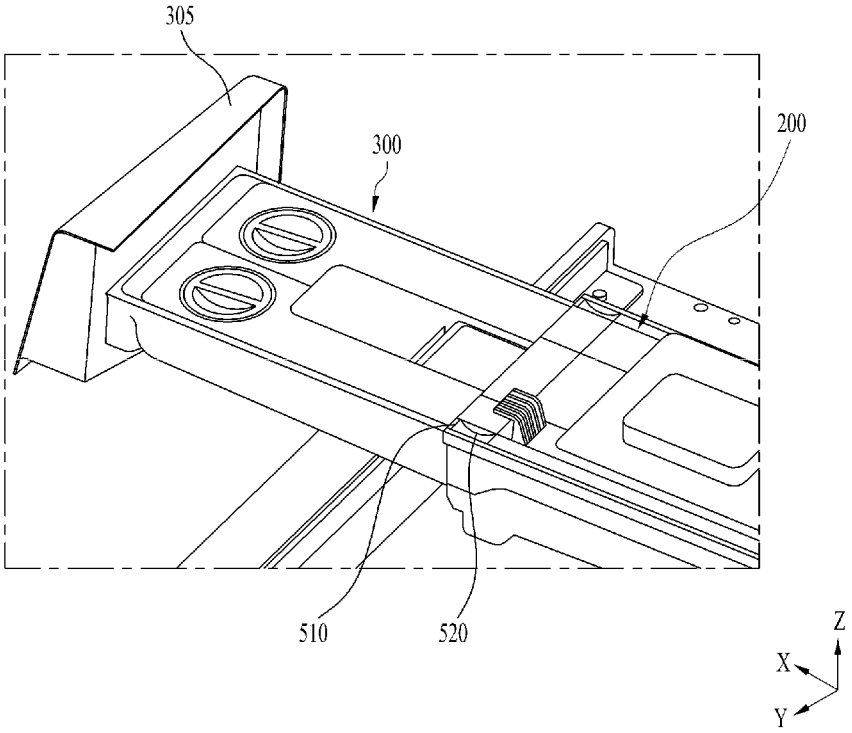
FIG. 16 is a view illustrating a sagging preventing portion in a state in which storage is extended in an embodiment of the present disclosure.
Figure 17:
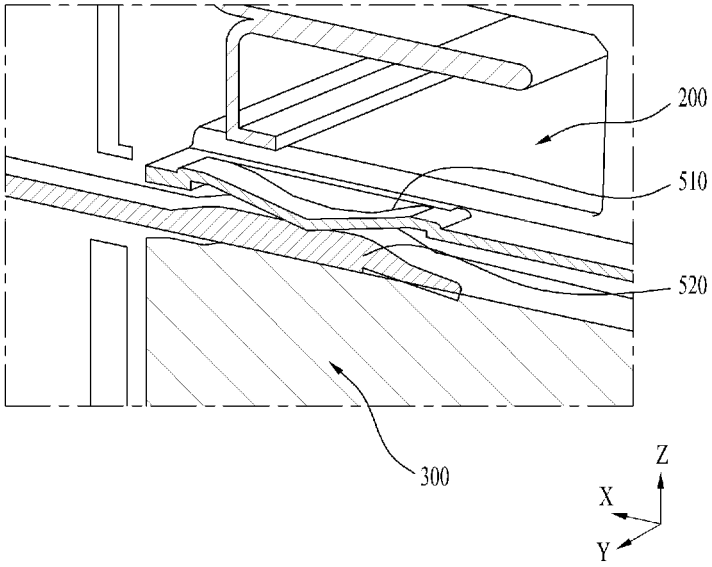
FIG. 17 is an enlarged view of a sagging preventing portion in FIG. 16.

In one example, FIG. 16 illustrates a sagging preventing elastic portion 510 viewed from the outside of the dispenser 200 in the extension process of the storage 300 according to an embodiment of the present disclosure, and FIG. 17 is an enlarged view of the sagging preventing elastic portion 510 and a sagging preventing protrusion 520 in FIG. 16.

Figure 18:
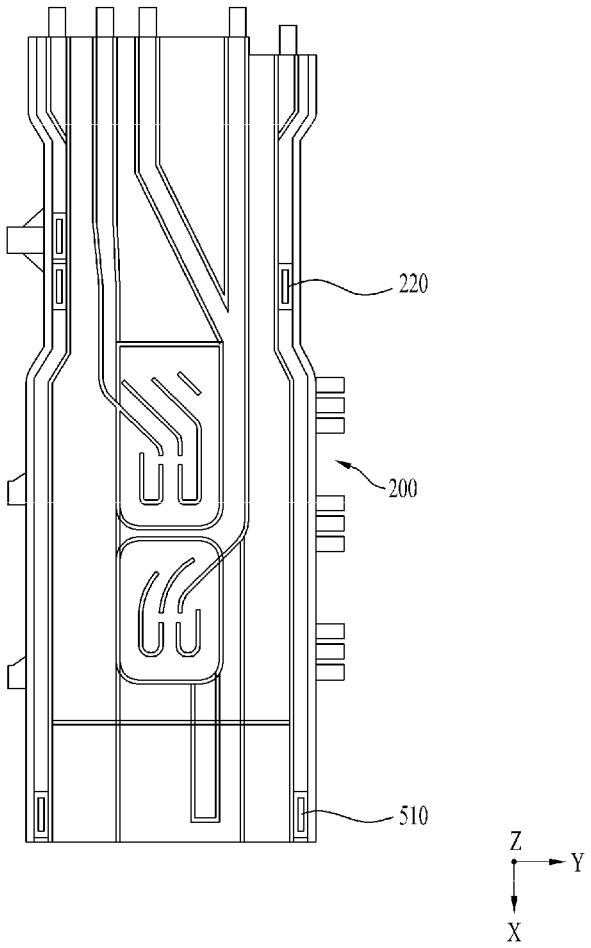
FIG. 18 is a view illustrating a sagging preventing elastic portion of a fixing portion in an embodiment of the present disclosure.
Figure 19:
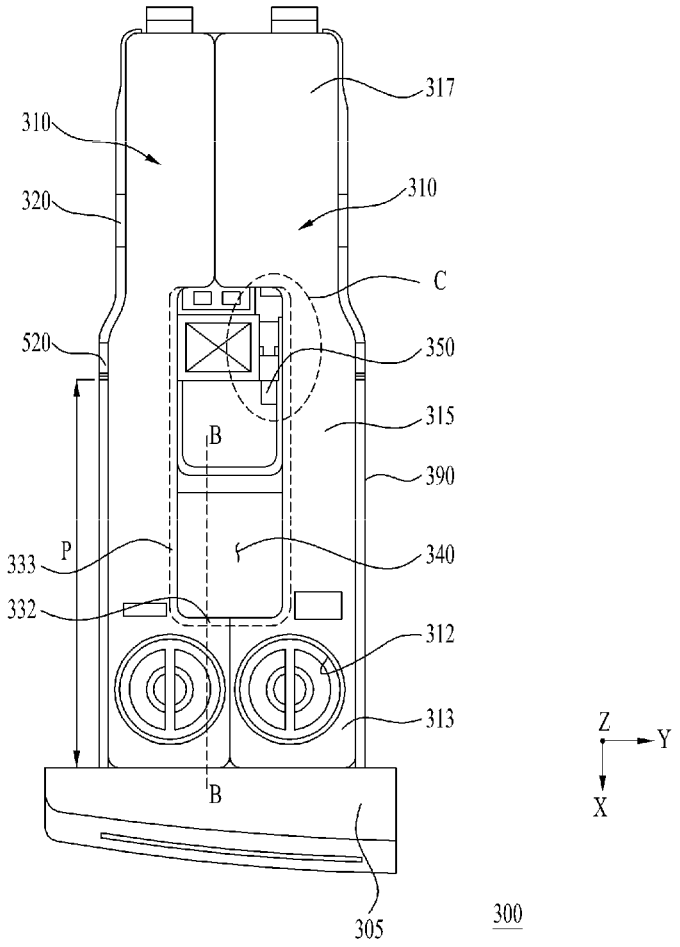
FIG. 19 is a top view of storage in an embodiment of the present disclosure.

In addition, FIG. 18 illustrates a position of the sagging preventing elastic portion 510 in the fixing portion, and FIG. 19 illustrates a position of the sagging preventing protrusion 520 in the storage 300.

Referring to FIGS. 16 and 19, an embodiment of the present disclosure may further include the sagging preventing elastic portion 510 disposed at the front end of the fixing portion and protruding toward the top face of the storage 300, and the sagging preventing protrusion 520 disposed on the top face of the storage 300, protruding toward the fixing portion, and rearwardly spaced from the sagging preventing elastic portion 510 by a set extension distance.

The sagging preventing elastic portion 510 may be disposed at the front end of the fixing portion. In addition, the sagging preventing elastic portion 510 may protrude toward the top face of the storage 300 like the engaging elastic portion 220 and may be elastically deformed and restored. The sagging preventing protrusion 520 may be disposed on the top face of the storage 300 and may protrude toward the fixing portion.

In the extension process of the storage 300, when a center of gravity of the storage 300 is positioned outward of the detergent opening 15 based on the front and rear direction X, a front end of the storage 300 may be inclined downward by a self-load thereof.

In an embodiment of the present disclosure, as the sagging preventing elastic portion 510 and the sagging preventing protrusion 520 are arranged, in the state in which the storage 300 is extended by the set extension distance, the sagging preventing protrusion 520 may prevent sagging of the storage 300 by pressing and being in close contact with the sagging preventing elastic portion 510.

That is, the sagging preventing elastic portion 510 may prevent the sagging of the storage 300 by pressing and supporting the sagging preventing protrusion 520 overlapped in the vertical direction Z. The set extension distance refers to an extension distance of the storage 300 set in advance such that the user may conveniently use the storage 300 even when the storage 300 is not completely separated from the detergent opening 15.

The sagging preventing elastic portion 510 is positioned in the fixing portion, for example, at the front end of the dispenser 200 to overlap the sagging preventing protrusion 520 on the storage 300 in the extended state and is advantageous in providing an elastic force.

In addition, as shown in FIG. 19, the sagging preventing protrusion 520 may be disposed to be spaced apart from the front end of the storage 300 by the set extension distance.

That is, an extension distance in which the sagging preventing protrusion 520 physically overlaps the sagging preventing elastic portion 510 in the extension process corresponds to the set extension distance according to an embodiment of the present disclosure.

That is, as shown in FIG. 19, a separation distance P from the front end of the storage 300 to the sagging preventing protrusion 520 may correspond to the set extension distance according to an embodiment of the present disclosure.

When the storage 300 extends from the detergent opening 15 by the set extension distance, the sagging preventing protrusion 520 may be positioned below the sagging preventing elastic portion 510 and pressed and supported by the sagging preventing elastic portion 510.

The user may identify the set extension distance considering appropriateness of use by recognizing a resistance or reaction force generated as the sagging preventing protrusion 520 and the sagging preventing elastic portion 510 overlap each other in the extension process of the storage 300. In addition, as will be described later, the storage 300 may be extended by the set extension distance and used even by restriction on the extension by an engaging portion 353 and a stopper 250.

In one example, in an embodiment of the present disclosure, the engaging protrusion 320 may be disposed on the top face of the storage 300, and the sagging preventing protrusion 520 may be positioned in front of the engaging protrusion 320 and the engaging elastic portion 220.

Referring to FIG. 18, the sagging preventing elastic portion 510 positioned at the front end of the fixing portion may be positioned in front of the engaging elastic portion 220. In addition, referring to FIG. 19, the sagging preventing protrusion 520 may be positioned in front of the engaging protrusion 320.

Further, referring to FIGS. 18 and 19, the sagging preventing protrusion 520 may be positioned in front of the engaging elastic portion 220 in the retraction and extension processes of the storage 300. Accordingly, a situation in which the sagging preventing protrusion 520 unnecessarily contacts the engaging elastic portion 220 may be prevented.

In one example, as will be described later, the engaging portion 353 and the stopper 250 may be arranged to restrict the extension distance of the storage 300 to the set extension distance. The engaging portion 353 may protrude from the storage 300 toward the fixing portion, for example, the dispenser 200, and the stopper 250 may be disposed in the fixing portion and protrude toward the storage 300.

When a movement of the engaging portion 353 is restricted by the stopper 250 in the extension process of the storage 300, the extension of the storage 300 may be restricted. Further, in a state in which the engaging portion 353 and the stopper 250 are in contact with each other, the sagging preventing protrusion 520 may be positioned below the sagging preventing elastic portion 510 and pressed.

In addition, the engaging portion 353 may be positioned in parallel with the sagging preventing protrusion 520 along a width direction Y of the storage 300, and the stopper 250 may be positioned in parallel with the sagging preventing elastic portion 510. The stopper 250 and the sagging preventing elastic portion 510 may be arranged in a front portion of the bottom face of the dispenser 200.

Figure 20:
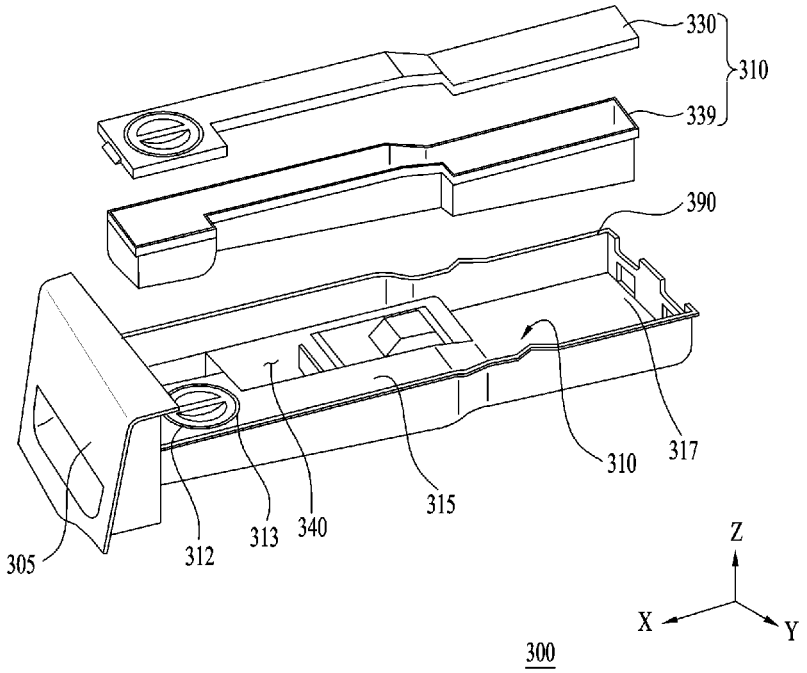
FIG. 20 is an exploded view of storage according to an embodiment of the present disclosure.

In one example, FIG. 19 illustrates the storage 300 viewed from above, and FIG. 20 illustrates a state in which the detergent reservoir 310 is separated from the storage 300.

Referring to FIGS. 19 and 20, in an embodiment of the present disclosure, the storage 300 includes a storage frame 390, a detergent reservoir 310 having a cap member 330, and an auxiliary detergent container 340.

A top face of the storage frame 390 is opened and the storage frame 390 is retracted into the cabinet 10 through the detergent opening 15. That is, the storage frame 390 may be retracted or extended by sliding through the detergent opening 15 in a state in which the detergent reservoir 310 is coupled thereto or seated thereon.

In the detergent opening 15, the feeder casing 400 shown in FIG. 4 may be installed. The storage frame 390 may be supported by the feeder casing 400 and may be retracted by sliding into the detergent opening 15.

The detergent reservoir 310 may include a casing 339 and the cap member 330. A top face of the casing 339 may be opened and the detergent may be stored in the casing 339. Further, the cap member 330 may be coupled to the open top face of the casing 339 in a detachable manner.

The casing 339 of the detergent reservoir 310 may have a shape extending in the front and rear direction X, and the storage frame 390 may also have a shape extending in the front and rear direction X. The cap member 330 may have a groove defined therein extending along an edge of the cap member 330, and an end of a side wall of the casing 339 may be inserted into the groove and detachably coupled to the cap member 330.

The detergent reservoir 310 may include a plurality of detergent reservoirs. FIGS. 19 and 20 illustrate that two detergent reservoirs 310 arranged in parallel with each other in the lateral direction Y according to an embodiment of the present disclosure are inserted in the storage frame 390. The detergent reservoir 310 may be retracted into or extended from the detergent opening 15 while being inserted into the storage frame 390.

In one example, the auxiliary detergent container 340 may be disposed in the storage frame 390. The auxiliary detergent container 340 may be separately manufactured and coupled to the storage frame 390 or may be integrally molded with the storage frame 390.

A top face of the auxiliary detergent container 340 is open, so that auxiliary detergent may be fed by the user and stored. The auxiliary detergent is not necessarily different from the detergent stored in the detergent reservoir 310, but a detergent having a different nature from that of the detergent in the detergent reservoir 310 is stored in response to a request of the user to improve a washing efficiency.

In some cases, the user may not store the detergent in the detergent reservoir 310, but store the detergent in the auxiliary detergent container 340 and feed the detergent to the drum 30 in the washing process.

The auxiliary detergent container 340 may include a front wall and a side wall. The auxiliary detergent may be injected and stored into a detergent storing space surrounded by the front and side walls. The front wall and the side wall of the auxiliary detergent container 340 may be integrally molded with the storage frame 390 or manufactured separately to have a coupling relationship with the storage frame 390.

The auxiliary detergent container 340 may be disposed adjacent to the detergent reservoir 310. For example, the detergent reservoir 310 may surround a front portion and a side portion of the auxiliary detergent container 340 and may be in contact with the front wall and the side wall of the auxiliary detergent container 340.

FIGS. 19 and 20 illustrate a state in which the auxiliary detergent container 340 is disposed adjacent to at least a portion of the detergent reservoir 310 in the lateral direction Y according to an embodiment of the present disclosure.

Figure 21:
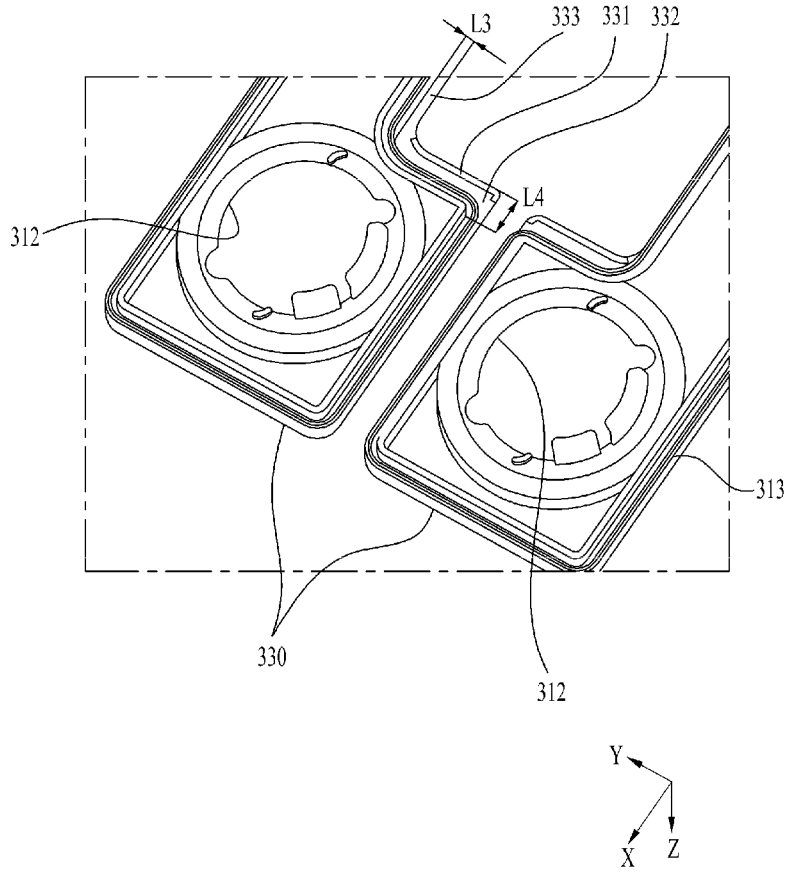
FIG. 21 is a view illustrating a cap member of a detergent reservoir according to an embodiment of the present disclosure.
Figure 22:
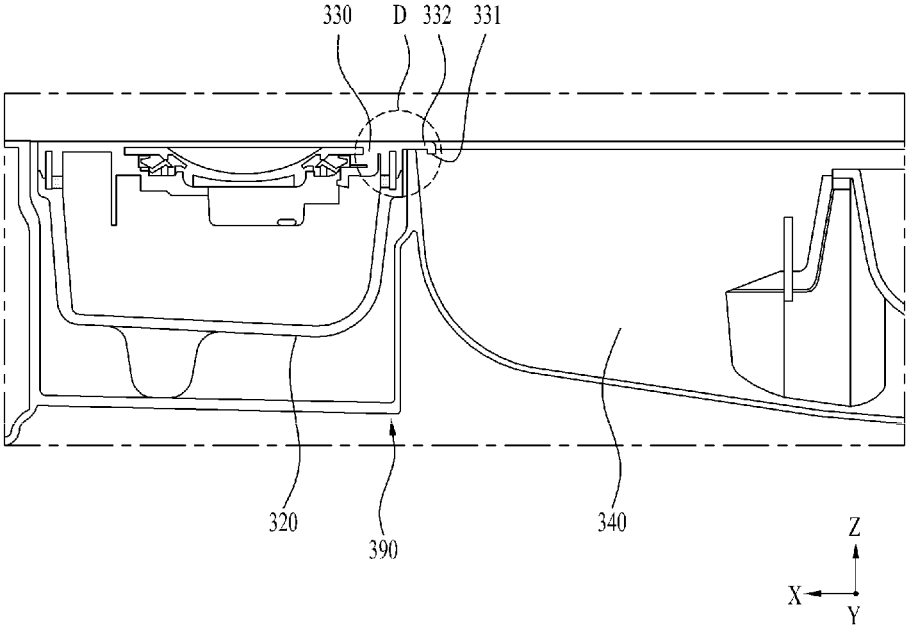
FIG. 22 is a cutaway view illustrating a detergent reservoir in FIG. 19 taken along a line B-B.

In one example, FIG. 21 is a view of the cap member 330 of the detergent reservoir 310 viewed from below, and FIG. 22 is a cross-sectional view of the storage 300 in FIG. 19 taken along a line B-B.

Referring to FIGS. 21 and 22, in an embodiment of the present disclosure, the cap member 330 may include a flange portion 333. The flange portion 333 may extend from the top face of the casing 339 along the top face of the auxiliary detergent container 340.

Specifically, the flange portion 333 may correspond to a protruding portion of the cap member 330 extending in parallel with the top face of the casing 339. The flange portion 333 may be formed on an entirety or only a portion of the edge of the cap member 330.

The flange portion 333 may be constructed to extend from the cap member 330 and cross an upper space defined by the front wall and the side wall of the auxiliary detergent container 340, and may extend along at least a portion of the front wall and the side wall of the auxiliary detergent container 340.

The flange portion 333 may include a gripping portion 332. The gripping portion 332 may be provided with a protrusion 331 protruding downward from an extended end of the flange portion 333. As the gripping portion 332 is constructed as a portion of the flange portion 333, the gripping portion 332 is constructed to protrude from the top face of the casing 339.

The user may grip the gripping portion 332 to separate the cap member 330 from the detergent reservoir 310. The gripping portion 332 protrudes in parallel with the top face of the casing 339, so that the user may easily grip the gripping portion 332.

In addition, the protrusion 331 may be disposed at an end of the gripping portion 332 along an extending direction from the cap member 330, and the protrusion 331 may protrude downward. FIG. 21 illustrates the gripping portion 332 on which the protrusion 331 is formed downward as a portion of the flange portion 333.

Figure 23:
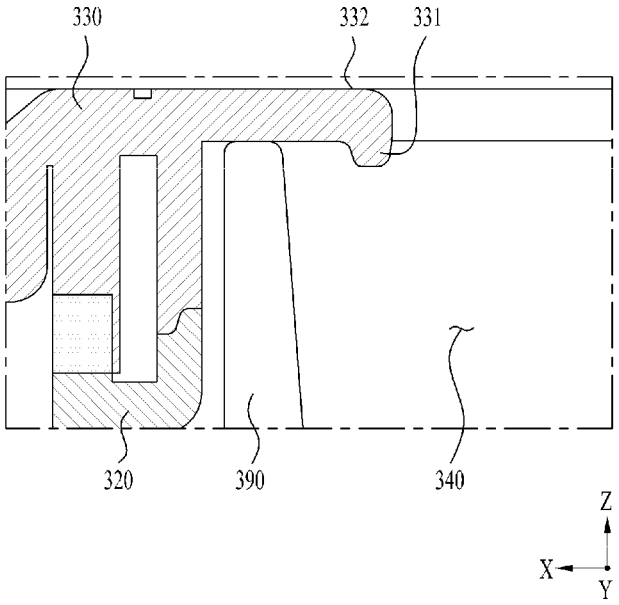
FIG. 23 is an enlarged view of a region D in FIG. 22.

FIG. 22 illustrates a cross-section of the gripping portion 332 on which the protrusion 331 extending away from the top face of the casing 339 to be positioned on the open top face of the auxiliary detergent container 340 and protruding downward is formed. FIG. 23 illustrates an enlarged view of a region D in FIG. 22.

The gripping portion 332 may have the protrusion 331 protruding downward so as to be advantageously gripped by the user. That is, when the user grips the gripping portion 332, a finger is caught by the protrusion 331 protruding downward, so that the user may effectively grip the gripping portion 332.

In one example, the gripping portion 332 is disposed on the flange portion 333 extending from the top face of the casing 339 toward the top face of the auxiliary detergent container 340. That is, the gripping portion 332 is positioned above the auxiliary detergent container 340 and prevents the auxiliary detergent contained in the auxiliary detergent container 340 from splashing to the outside.

Specifically, the detergent reservoir 310 and the auxiliary detergent container 340 are extended from the detergent opening 15 together with the storage frame 390 or retracted to the detergent opening 15, In the auxiliary detergent container 340, whose top face is opened by the motion generated in this process, the internal auxiliary detergent may splash outward due to inertia or impact.

Specifically, the detergent reservoir 310 and the auxiliary detergent container 340 are extended from the detergent opening 15 or retracted into the detergent opening 15 together with the storage frame 390. Because of a motion occurred in such process, the auxiliary detergent inside the auxiliary detergent container 340 with the open top face may splash outward because of inertia or an impact.

An embodiment of the present disclosure may block the flow of the auxiliary detergent of scattering or splashing from the auxiliary detergent container 340 and prevent leakage of the auxiliary detergent as the flange portion 333 and the gripping portion 332 of the cap member 330 extend above the auxiliary detergent container 340, that is, on the open top face of the auxiliary detergent container.

In addition, because the gripping portion 332 has the protrusion 331 protruding downward at the extended end thereof, the protrusion 331 contributes to suppressing the motion of the auxiliary detergent splashing out of the auxiliary detergent container 340.

For example, the auxiliary detergent splashing toward the gripping portion 332 is not able to be scattered outward by an extended face 375 of the gripping portion 332 and is returned to the auxiliary detergent container 340, but may still have a fast speed in the return process. Accordingly, the returned auxiliary detergent may induce another scattering of the auxiliary detergent by applying an impact or transmitting a kinetic force to the auxiliary detergent inside the auxiliary detergent container 340.

However, in an embodiment of the present disclosure, as the protrusion 331 protruding downward is disposed on the gripping portion 332, the flow of the auxiliary detergent that did not leak outward by the extended face 375 of the gripping portion 332 is inhibited once again by the protrusion 331 of the gripping portion 332, so that the speed of the auxiliary detergent is greatly reduced. Therefore, in the process in which the scattered auxiliary detergent returns back to the auxiliary detergent container 340, the kinetic force may be greatly reduced and stable return may be induced.

In one example, referring to FIGS. 19 to 21, in an embodiment of the present disclosure, the detergent reservoir 310 may be positioned in front of and next to the auxiliary detergent container 340, the flange portion 333 may be positioned at a front portion and a side portion of the top face of the auxiliary detergent container 340, and the gripping portion 332 may be formed at a front portion of the flange portion 333 positioned at the front portion of the auxiliary detergent container 340.

Specifically, the detergent reservoir 310 is positioned in front of and next to the auxiliary detergent container 340, so that the flange portion 333 may be positioned on the top face of the auxiliary detergent container 340. The detergent reservoir 310 may include a plurality of detergent reservoirs and the plurality of detergent reservoirs may be respectively disposed in the front of and next to the auxiliary detergent container 340. Alternatively, at least one face of the detergent reservoir 310 may be bent such that one of the detergent reservoirs may be positioned both in the front and next to the auxiliary detergent container 340.

FIG. 19 illustrates a state in which the auxiliary detergent container 340 is disposed between the two detergent reservoirs 310, and the detergent reservoir 310 has a shape with a front portion protruding such that a portion of the detergent reservoir 310 may be positioned in front of the auxiliary detergent container 340, according to an embodiment of the present disclosure.

Based on the positional relationship between the detergent reservoir 310 and the auxiliary detergent container 340 as described above, the auxiliary detergent may be prevented from splashing forward and lateralward of the auxiliary detergent container 340.

Furthermore, the flange portion 333 may have the gripping portion 332 formed at the front side of the auxiliary detergent container 340. Accordingly, the situation in which the auxiliary detergent splashed forward of the auxiliary detergent container 340 may be more effectively prevented by the gripping portion 332.

The storage 300 is moved inside the detergent opening 15 along the front and rear direction X, so that the auxiliary detergent is easy to splash forward. Therefore, an embodiment of the present disclosure may effectively suppress the leakage of the auxiliary detergent by disposing the gripping portion 332 at the front side of the auxiliary detergent container 340 on the flange portion 333 positioned at the front portion and the side portion of the top face of the auxiliary detergent container 340.

Furthermore, in the situation in which the storage 300 is extended by the set extension distance or fully extended from the cabinet 10, the user grips the gripping portion 332 positioned at the front side of the auxiliary detergent container 340, so that the cap member 330 may be efficiently separated from the casing 339 of the detergent reservoir 310, which is advantageous.

In one example, in an embodiment of the present disclosure, the detergent reservoir 310 may include a detergent injection portion 313, a connection portion 315, and a detergent discharge portion 317. The connection portion 315 may be positioned next to the auxiliary detergent container 340 and the detergent injection portion 313 may be positioned in front of the auxiliary detergent container 340.

The detergent injection portion 313 may be positioned at a front end of the detergent reservoir 310, and may have a detergent injection hole 312 defined therein into which the detergent is injected. The detergent injection hole 312 may be defined in the cap member 330. As the detergent injection portion 313 is disposed at the front end of the detergent reservoir 310, even when the user extends the storage 300 by the set extension distance described above, the detergent may be injected into the detergent injection hole 312.

The connection portion 315 may be positioned at a center of the detergent reservoir 310. That is, the connection portion 315 may correspond to a portion connecting the detergent injection portion 313 and the detergent discharge portion 317 with each other. The detergent injection portion 313, the connection portion 315, and the detergent discharge portion 317 may be manufactured separately from each other. FIGS. 19 and 20 illustrate the detergent reservoir 310 in which the detergent injection portion 313, the connection portion 315, and the detergent discharge portion 317 are integrally formed according to an embodiment of the present disclosure.

The detergent injected through the detergent injection portion 313 may be stored together in the connection portion 315 and the detergent discharge portion 317 as well as in the detergent injection portion 313, and may be discharged through a detergent valve 380 to be described later of the detergent discharge portion 317 and provided into the drum 30 in the washing process.

The auxiliary detergent container 340 may be disposed adjacent to the connection portion 315 of the detergent reservoir 310 in the lateral direction Y. In addition, as shown in FIG. 19, the detergent injection portion 313 constructed to protrude in the lateral direction Y than the connection portion 315 may be positioned in front of the auxiliary detergent container 340.

Specifically, the detergent injection portion 313 may have a width greater than that of the connection portion 315 and a portion of the detergent injection portion 313 may protrude in the lateral direction Y than the connection portion 315. That is, the detergent injection portion 313 may include a lateral protrusion protruding in the lateral direction Y than the connection portion 315.

The auxiliary detergent container 340 may be positioned rearward of the protrusion of the detergent injection portion 313, and the gripping portion 332 may be formed to extend rearward from the detergent injection portion 313. That is, the gripping portion 332 may be disposed at the lateral protrusion protruding from the detergent injection portion 313 in the lateral direction Y than the connection portion 315.

As above, the detergent reservoir 310 may be effectively positioned next to and in front of the auxiliary detergent container 340 by a shape of the detergent reservoir 310 and an arrangement of the auxiliary detergent container 340, and the auxiliary detergent of the auxiliary detergent container 340 may be prevented from leaking outward by the flange portion 333 and the gripping portion 332.

In addition, a ventilation hole 360 as will be described later may be defined in a top face of the detergent injection portion 313 in the detergent reservoir 310, that is, a portion corresponding to the top face of the detergent injection portion 313 in the cap member 330, In an embodiment of the present disclosure, as the gripping portion 332 is disposed in the detergent injection portion 313, when the user separates the detergent reservoir 310 from the storage frame 390, the user lifts the detergent reservoir 310 while gripping the gripping portion 332. Thus, the detergent injection portion 313 in which the ventilation hole 360 is defined is lifted upward first, so that the leakage of the detergent through the ventilation hole 360 may be prevented in the separation process of the detergent reservoir 310.

Figure 48:
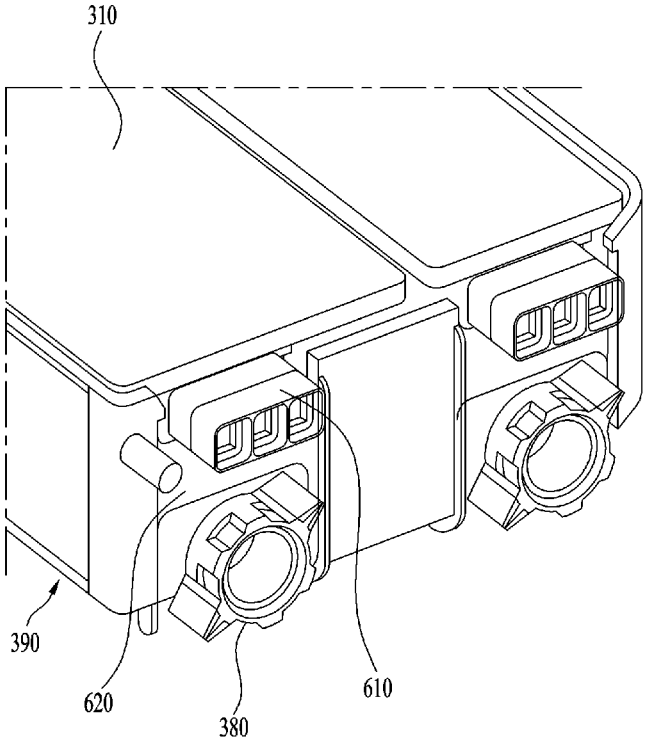
FIG. 48 is a view illustrating a rear face of a storage frame into which a detergent reservoir is inserted in an embodiment of the present disclosure.

In one example, FIG. 48 illustrates a rear face of the storage frame 390 in a state in which the detergent reservoir 310 is inserted. Referring to FIG. 48, a sensor terminal 610 and the detergent valve 380 may be arranged to protrude on a rear face of the detergent reservoir 310.

Specifically, a capacity sensor for measuring a detergent capacity may be installed on the rear face of the detergent reservoir 310, and the sensor terminal 610 of the capacity sensor may protrude rearward from the rear face of the detergent reservoir 310.

In addition, as will be described later, the detergent valve 380 may be installed on the rear face of the detergent reservoir 310 to protrude. In an embodiment of the present disclosure, the sensor terminal 610 may be positioned in an upper portion of the rear face of the detergent reservoir 310, and the detergent valve 380 may be positioned in a lower portion of the rear face of the detergent reservoir 310.

The rear face of the storage frame 390 may face the rear face of the detergent reservoir 310, and portions of the storage frame 390 corresponding to the sensor terminal 610 and the detergent valve 380 of the detergent reservoir 310 may be opened. In one example, a holding portion 620 disposed to extend at a portion between the sensor terminal 610 and the detergent valve 380 may be disposed on the rear face of the storage frame 390.

The holding portion 620 may have a shape extending along the width direction Y of the storage frame 390, and the rear face of the storage frame 390 may have a shape in which both portions above and below the holding portion 620 are open as shown in FIG. 48.

When the user grips the gripping portion 332 and lifts the detergent reservoir 310 from the storage frame 390, as a movement of the detergent valve 380 in the upward direction is suppressed by the holding portion 620, the detergent injection portion 313 of the detergent reservoir 310 may be separated from the storage frame 390 earlier than the detergent discharge portion 317, and the leakage of the detergent through the ventilation hole 360 may be further suppressed.

In one example, referring to FIG. 19, in an embodiment of the present disclosure, the detergent reservoir 310 may include a pair of detergent reservoirs, and the pair of detergent reservoirs 310 may be arranged adjacent to each other in the lateral direction Y. Respective faces of the detergent injection portions 313 facing each other may be in contact with each other, respective connection portions 315 may be spaced apart from each other, and the auxiliary detergent container 340 may be positioned between the respective connection portions 315 of the pair of detergent reservoirs 310.

Accordingly, the auxiliary detergent container 340 may be positioned so as to be surrounded by the pair of detergent reservoirs 310 on one plane. In addition, while the auxiliary detergent container 340 is disposed in the internal space of the storage frame 390, the pair of detergent reservoirs 310 may secure sufficient space and improve detergent storage capacity.

In one example, the flange portion 333 may be disposed by being divided for the front portion and the side portion of the top face of the auxiliary detergent container 340. However, as shown in FIG. 21, the flange portion 333 may extend continuously along the front portion and the side portion of the top face of the auxiliary detergent container 340.

Further, referring to FIG. 21, in the flange portion 333, the front portion disposed in the front portion of the top face of the auxiliary detergent container 340 may extend toward the auxiliary detergent container 340 to be longer than the side portion disposed in the side portion of the top face of the auxiliary detergent container 340.

As described above, when considering a moving path of the storage 300, the auxiliary detergent container 340 has a higher possibility of leakage of the auxiliary detergent at the front portion than the side portion. Accordingly, in an embodiment of the present disclosure, the front portion of the flange portion 333 is formed to be longer than the side portion, so that the leakage of the auxiliary detergent in the forward direction from the auxiliary detergent container 340 may be more effectively suppressed.

The front portion of the flange portion 333 may correspond to the gripping portion 332. FIG. 21 illustrates a state in which an extended length L4 of the front portion is longer than an extended length L3 of the side portion.

Figure 24:
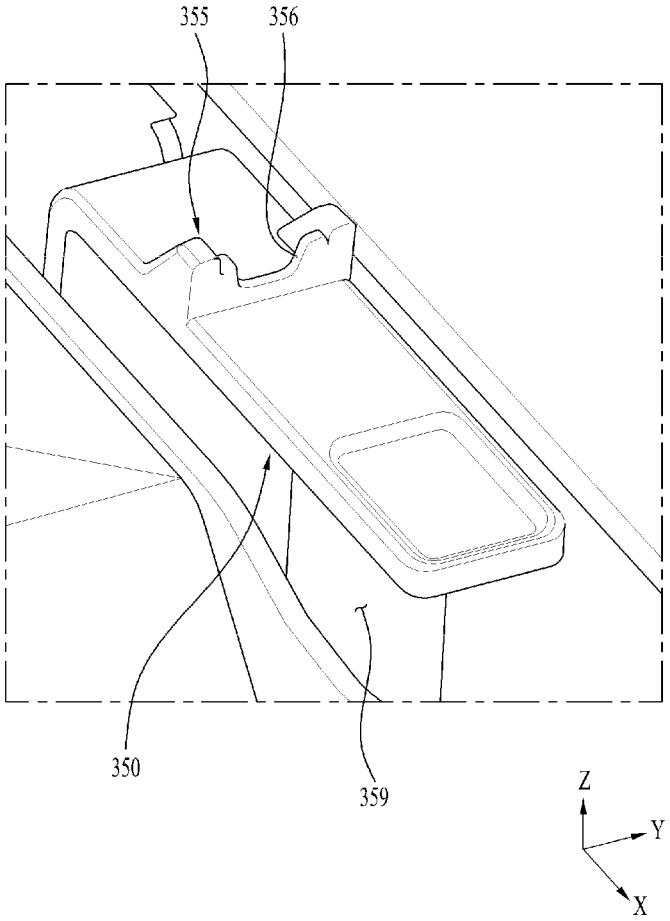
FIG. 24 is an enlarged view of a region C in FIG. 19.

In one example, FIG. 24 illustrates an enlarged view of a region C in FIG. 19, and the engaging portion 353 disposed on the storage 300 is illustrated. In addition, the bottom face of the dispenser 200 is illustrated in FIG. 25, and the stopper 250 disposed on the bottom face of the dispenser 200 is illustrated.

Figure 25:
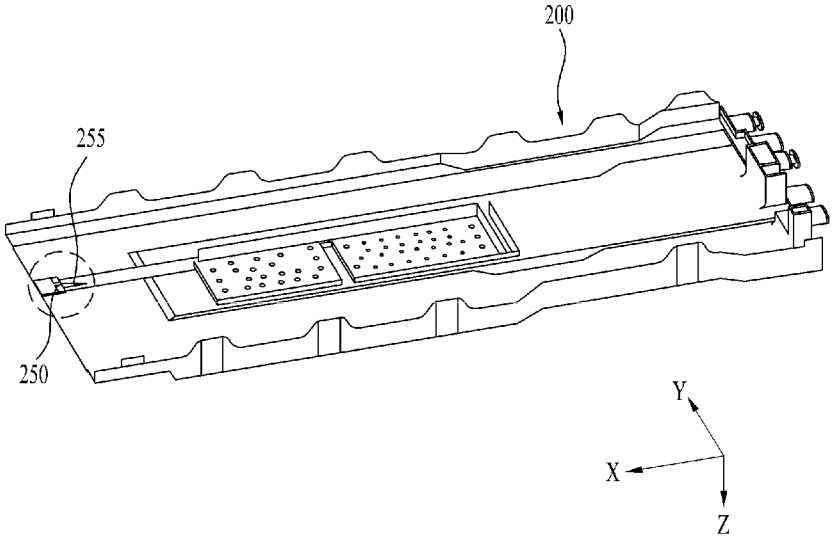
FIG. 25 is a view illustrating a bottom face of a dispenser in an embodiment of the present disclosure.
Figure 26:
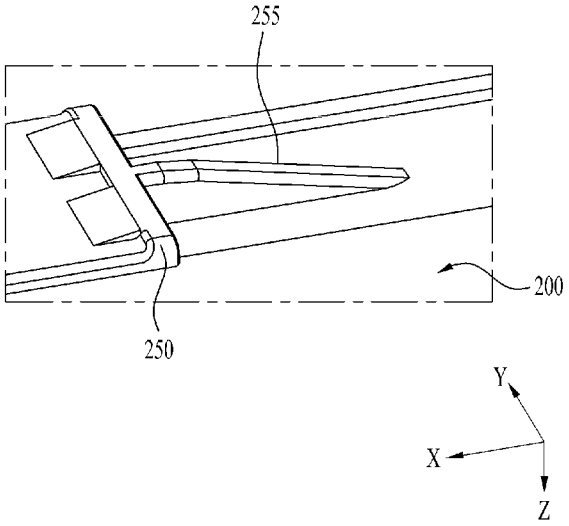
FIG. 26 is an enlarged view of a region E in FIG. 25.

FIG. 26 illustrates an enlarged view of a region E in FIG. 25, and the stopper 250 of the dispenser 200 is illustrated in the region E. The stopper 250 and the engaging portion 353 are illustrated together in FIG. 27.

Referring to FIGS. 24 to 27, an embodiment of the present disclosure further includes the stopper 250 and the engaging portion 353. In an embodiment of the present disclosure, the dispenser 200 is disposed inside the cabinet 10, that is, inside the detergent opening 15, and is disposed to face the top face of the storage 300.

The stopper 250 may be disposed on the dispenser 200 and may protrude downward toward the storage 300. The stopper 250 may be disposed on the bottom face of the dispenser 200, and may be disposed so as not to overlap the engaging elastic portion 220 and the sagging preventing elastic portion 510 described above in the front and rear direction X. That is, the stopper 250 may be disposed to be spaced apart from the engaging elastic portion 220 and the sagging preventing elastic portion 510 in the lateral direction Y.

The engaging portion 353 may be disposed on the storage 300 and may protrude upward toward the dispenser 200. The engaging portion 353 may be disposed so as not to overlap the engaging protrusion 320 in the front and rear direction X. For example, the engaging protrusion 320 may be disposed on a side wall of the storage frame 390, and the engaging portion 353 may be disposed at a center of the storage frame 390 based on the lateral direction Y.

The stopper 250 may be disposed in parallel with the engaging portion 353 along the front and rear direction X and overlap with the engaging portion 353. Thus, in the extension process of the storage 300, the stopper 250 may overlap the engaging portion 353, and thus, the movement may be restricted.

In addition, in the state in which the storage 300 is retracted into the detergent opening 15, the stopper 250 may be disposed to be forwardly spaced apart from the engaging portion 353, and a separation distance between the stopper 250 and the engaging portion 353 may correspond to the set extension distance described above.

Thus, when the user extends the storage 300 by gripping the handle 305 of the storage 300 in the state in which the storage 300 is retracted into the detergent opening 15, when the engaging portion 353 of the storage 300 in in contact with the stopper 250 of the dispenser 200, the extension of the storage 300 may be restricted and the user may store the detergent using the storage 300 extended by the set extension distance.

That is, in the state in which the engaging portion 353 is in contact with the stopper 250, the sagging preventing protrusion 520 of the storage 300 may overlap the sagging preventing elastic portion 510 of the dispenser 200 in the vertical direction Z to prevent sagging of the storage 300.

Figure 27:
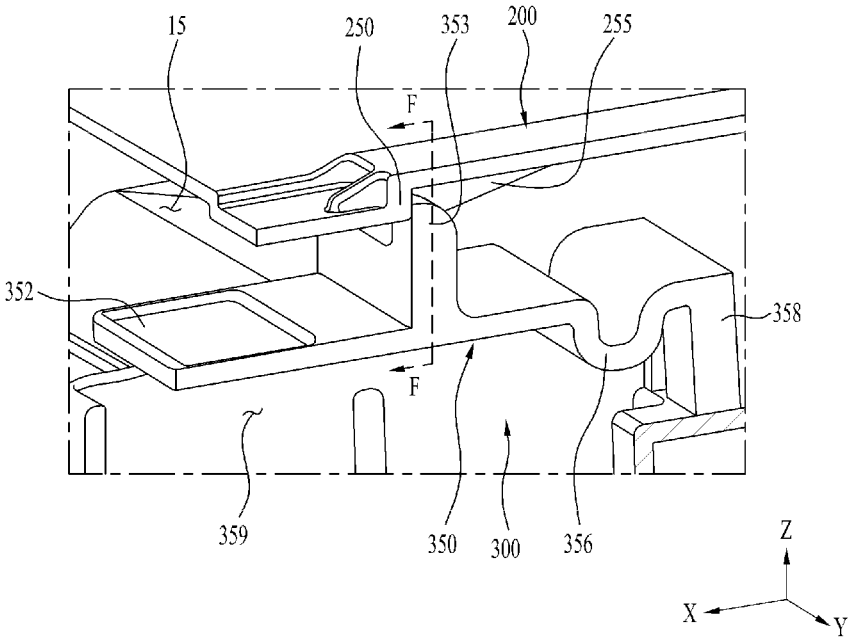
FIG. 27 is a view illustrating a stopper and an engaging portion in an extended situation of storage in an embodiment of the present disclosure.
Figure 28:
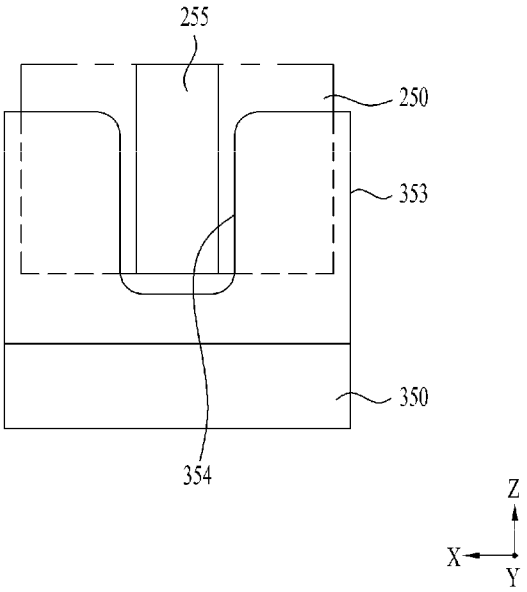
FIG. 28 is a cross-sectional view taken along a line F-F of a stopper and an engaging portion in FIG. 27.

FIG. 28 is a cross-sectional view viewed from the rear of the state in which the engaging portion 353 is in contact with the stopper 250 as shown in FIG. 27. In an embodiment of the present disclosure, as the engaging portion 353 and the stopper 250 are arranged, it is easy for the user to extend the storage 300 only by the set extension distance, so that the detergent feeder 100 may be efficiently utilized.

In one example, referring to FIG. 27, in an embodiment of the present disclosure, an elastic bar 350 may be further included in the storage 300, and the elastic bar 350 may be exposed outward of the front end of the storage 300 and the detergent opening 15 in the state in which the storage 300 is extended by the set extension distance.

Specifically, the elastic bar 350 may have a rear end fixed to the storage 300, and a front end thereof may form a free end. Accordingly, the elastic bar 350 may be elastically deformed and the front end thereof may be moved in the vertical direction Z with respect to the rear end. This may be accomplished by the user pressing the front end of the elastic bar 350.

The engaging portion 353 may protrude upward at a position between the front end and the rear end of the elastic bar 350. Thus, when the engaging portion 353 is in contact with the stopper 250 and the extension of the storage 300 is restricted, the front end of the elastic bar 350 positioned in front of the engaging portion 353 may be exposed to the outside of the detergent opening 15, which facilitates the user to press the front end of the elastic bar 350.

The user may separate the engaging portion 353 downward from the stopper 250 by pressing the front end of the elastic bar 350 exposed forward of the detergent opening 15. As will be described later, the user may completely extend and separate the storage 300 from the detergent opening 15 while releasing the extension restriction based on the set extension distance.

Figure 29:
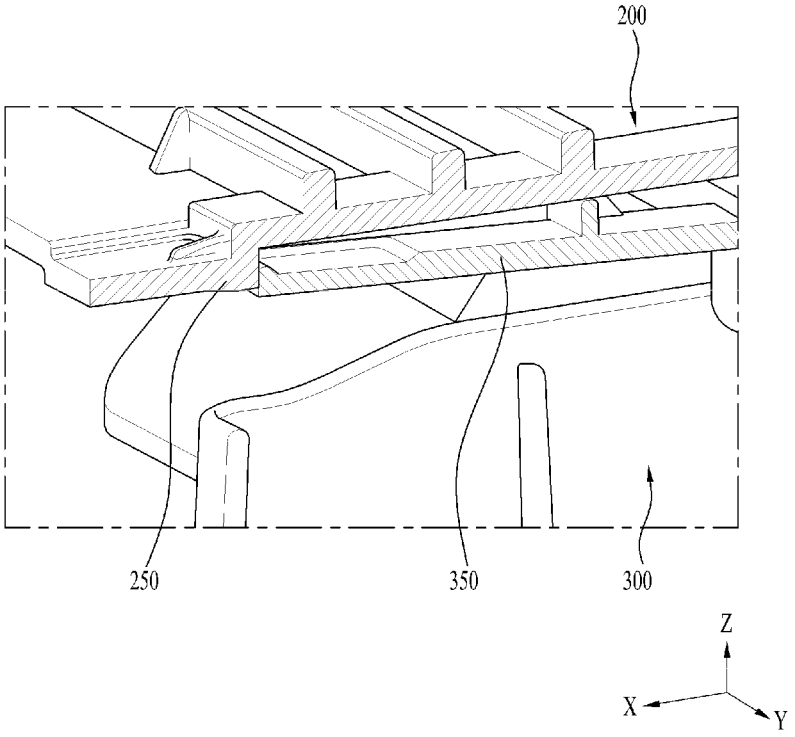
FIG. 29 is a view illustrating a state in which an elastic bar in FIG. 27 is pressed.

In one example, FIG. 29 illustrates the elastic bar 350 in a state of being moved downward as a pressing portion 352 of the front end is pressed according to an embodiment of the present disclosure.

Referring to FIGS. 27 and 29, in an embodiment of the present disclosure, the storage 300 may have a deformation space 359 defined below the front end of the elastic bar 350. The elastic bar 350 may have the pressing portion 352 pressed by the user on a top face of the front end. The front end may be elastically deformed so as to move toward the deformation space 359 by a pressing force transmitted to the pressing portion 352.

The storage 300 may have the deformation space 359 above which the elastic bar 350 is positioned. The elastic bar 350 may have the pressing portion 352 pressed by the user at the front end thereof. As shown in FIG. 27, a groove may be defined in the pressing portion 352 to facilitate the user's pressing.

The deformation space 359 may be positioned below the elastic bar 350, and a width thereof may correspond to the elastic bar 350. The rear end of the elastic bar 350 may be coupled with the storage 300 above the deformation space 359 or at the rear of the deformation space 359.

The front end of the elastic bar 350 at which the pressing portion 352 is pressed may be positioned in the deformation space 359. The elastic bar 350 may be elastically deformed such that the front end thereof moves downward when the pressing portion 352 is pressed. In this case, the engaging portion 353 protruding upward from the elastic bar 350 may also be moved downward. Therefore, the engaging portion 353 and the stopper 250 do not overlap each other based on the front and rear direction X, so that the user may extend the storage 300 completely.

As an entirety, the rear end, or a portion of the elastic bar 350 may be elastically deformed, the front end of the elastic bar 350 may move downward to be positioned inside the deformation space 359.

In one example, referring to FIG. 27, in an embodiment of the present disclosure, the elastic bar 350 may include an upward extension portion 358 at which the rear end of the elastic bar 350 extends upward from a coupling point with the storage 300, and the front end of the elastic bar 350 may extend forward from the upward extension portion 358 to form the free end.

Specifically, the elastic bar 350 may be positioned to be spaced upward from the bottom face of the storage 300, that is, the storage frame 390 through the upward extension portion 358. Accordingly, the front end of the elastic bar 350 may form the free end spaced apart from the bottom face of the storage frame 390.

In addition, in an embodiment of the present disclosure, the elastic bar 350 may include a bent portion 356 positioned rearward of the engaging portion 353 and bent in the vertical direction Z.

FIG. 27 illustrates the bent portion 356 bent to protrude downward. The bent portion 356 may be formed in a bent or curved shape, so that the front end of the elastic bar 350 may be easily moved in the vertical direction Z.

That is, in an embodiment of the present disclosure, when the pressing portion 352 is pressed while the front end of the elastic bar 350 maintains a shape thereof with rigidity, the bent portion 356 may be deformed, so that the front end of the elastic bar 350 may be moved downward.

Unlike the front end or the rear end of the elastic bar 350, the bent portion 356 may be made of a material having high elasticity, or may be integrally molded with the front end and the rear end as an entirety of the elastic bar 350 and be formed in a curved shape.

Referring to FIG. 19 again, in an embodiment of the present disclosure, the engaging portion 353 is positioned rearward of the auxiliary detergent container 340, so that the auxiliary detergent container 340 may be exposed to the outside of the detergent opening 15 in the state in which the storage 300 is extended and the engaging portion 353 is in contact with the stopper 250.

As described above, because the position of the engaging portion 353 may correspond to the set extension distance with respect to the storage 300, the auxiliary detergent container 340 may be positioned forward of the engaging portion 353 to facilitate the use of the storage 300 even when the user extends the storage 300 by the set extension distance.

Thus, in the state in which the storage 300 is extended by the set extension distance, the user may inject the detergent through the detergent injection hole 312 defined in front of the detergent reservoir 310 or may inject the auxiliary detergent into the auxiliary detergent container 340 positioned rearward of the detergent injection portion 313.

In one example, in an embodiment of the present disclosure, the dispenser 200 may further include a guide protrusion 255. FIG. 26 illustrates the guide protrusion 255 enlarged and viewed from below, and FIGS. 27 and 28 illustrate the guide protrusion 255 inserted into a groove 354.

Referring to FIGS. 26 to 28, the guide protrusion 255 may extend rearward from the rear face of the stopper 250 and may have a smaller width than the stopper 250. The engaging portion 353 may have the groove 354 defined at a center thereof in the width direction Y, and the guide protrusion 255 may be inserted into the groove 354 in the state in which the storage 300 is extended and the engaging portion 353 is in contact with the stopper 250.

Figure 30:
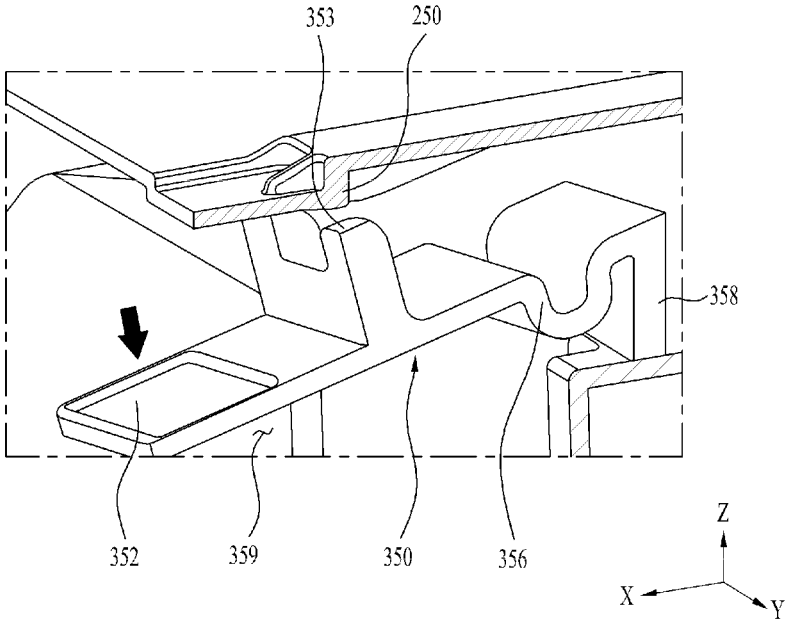
FIG. 30 is a view illustrating a state in which an engaging portion is removed in an embodiment of the present disclosure.

In one example, FIG. 30 illustrates a state in which the front end of the elastic bar 350 is caught by the stopper 250 in a state in which the guide protrusion 255 is removed. In the extension process of the storage 300, the front end of the elastic bar 350 protruding forward to form the free end may be unintentionally caught by the stopper 250 depending on a use environment.

In this case, the user becomes not able to extend the storage 300 by the set extension distance and the detergent reservoir 310 or the auxiliary detergent container 340 becomes not able to be exposed to the outside of the detergent opening 15, which may make it difficult for the user to use the apparatus.

An embodiment of the present disclosure may include the guide protrusion 255 and the groove 354 to prevent the front end of the elastic bar 350 from interfering with the extension of the storage 300 by being in contact with the stopper 250.

The guide protrusion 255 may have the smaller width than the stopper 250, and the groove 354 may have a width corresponding to the guide protrusion 255. The engaging portion 353 may have a larger width than the groove 354.

The guide protrusion 255 extends rearward from a rear face of the stopper 250. Accordingly, the situation in which the elastic bar 350 is unintentionally positioned such that the front end overlaps the stopper 250 may be prevented.

For example, in the extension process of the storage, a vertical level of the front end of the elastic bar 350 may be restricted by the guide protrusion 255 before reaching the stopper 250. Accordingly, the front end of the elastic bar 350 that has reached the stopper 250 is positioned at a vertical level lower than the stopper 250 by the guide protrusion 255, so that the front end of the elastic bar 350 does not contact the stopper 250.

In one example, the groove 354 is defined at the center of the engaging portion 353 and the engaging portion 353 moves forward in the state in which the guide protrusion 255 is inserted into the groove 354, so that there is no restriction of the movement by the guide protrusion 255.

When the engaging portion 353 reaches the stopper 250, the engaging portion 353 having the larger width than the groove 354 overlaps and in contact with the stopper 250 having the larger width than the guide protrusion 255. Therefore, the engaging portion 353 may be completely in contact with the stopper 250 and may restrict the extension of the storage 300 at the set extension distance.

In one example, in an embodiment of the present disclosure, as the guide protrusion 255 is further away from the stopper 250, a protruding height thereof from the fixing portion gradually decreases, so that a bottom face thereof may be inclined.

FIG. 26 illustrates the guide protrusion 255 having the inclined bottom face viewed from below, and FIG. 27 illustrates a state in which the guide protrusion 255 having the inclined bottom face is inserted into the groove 354.

As the bottom face of the guide protrusion 255 is inclined such that the protruding length or height thereof decreases rearwardly, the situation in which the front end of the elastic bar 350 is unintentionally caught by the guide protrusion 255 and the movement thereof is restricted may be effectively prevented. Further, because the front end of the elastic bar 350 is naturally induced to be at a vertical level lower than the stopper 250 along the inclined bottom face, the unintended overlapping situation of the elastic bar 350 may be effectively prevented.

Figure 31:
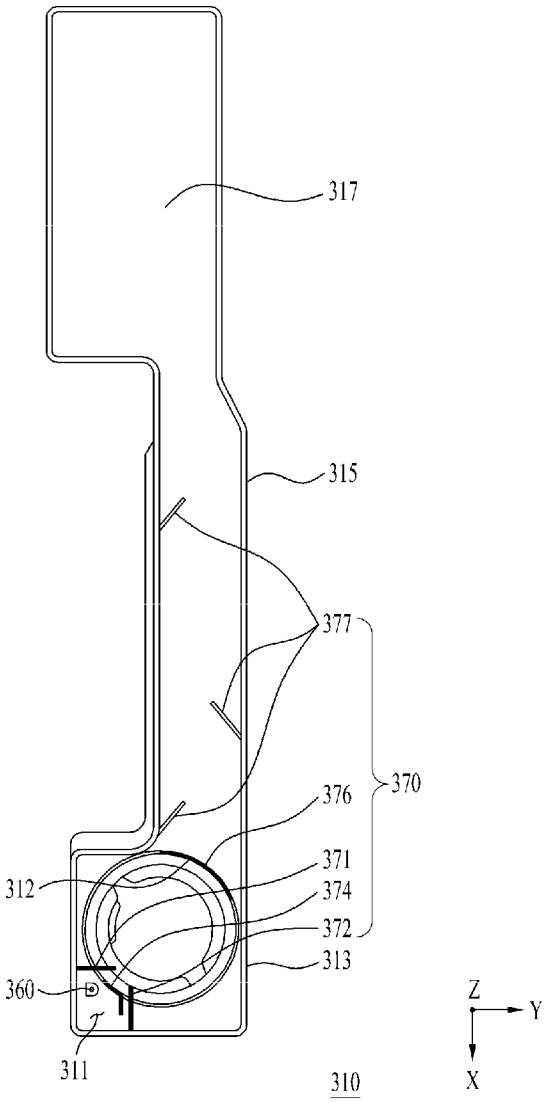
FIG. 31 is a top view of a detergent reservoir in an embodiment of the present disclosure.
Figure 32:
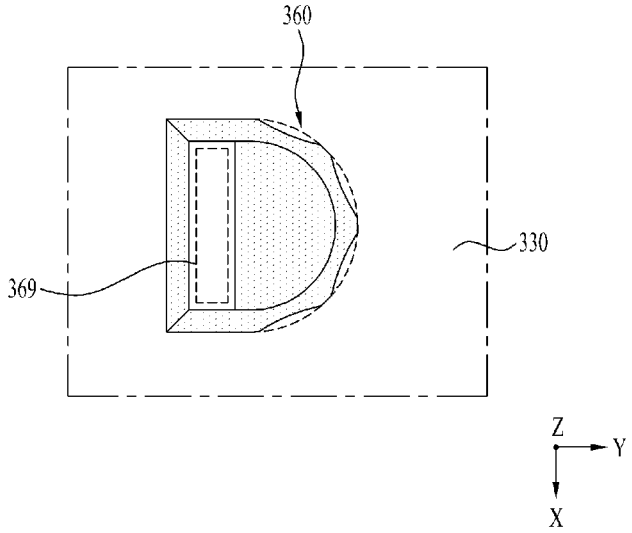
FIG. 32 is an enlarged view illustrating a ventilation hole of a detergent reservoir in FIG. 31.
Figure 33:
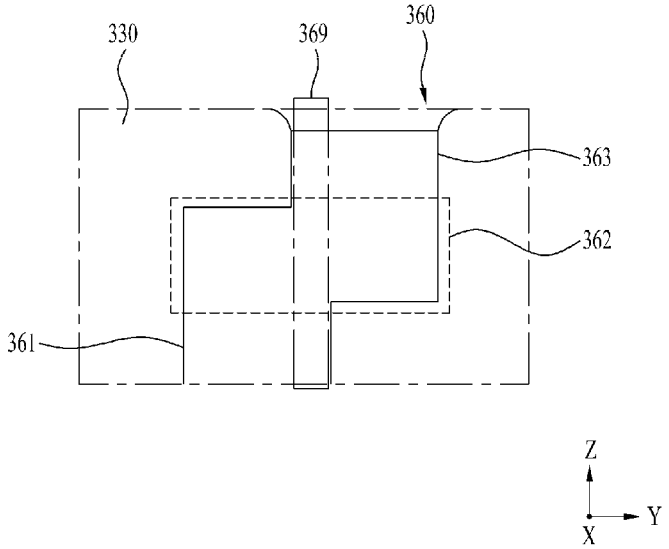
FIG. 33 is a view illustrating a cross-section of a ventilation hole in an embodiment of the present disclosure.

In one example, FIG. 31 illustrates a view of the detergent reservoir 310 viewed from above, FIG. 32 illustrates a view of the ventilation hole 360 of the detergent reservoir 310 viewed from above, and FIG. 33 illustrates a cross-sectional view of the ventilation hole 360 cut in the vertical direction Z.

Referring to FIGS. 31 to 33, in an embodiment of the present disclosure, the ventilation hole 360 may be defined in the detergent reservoir 310 that stores the detergent therein and is inserted into the detergent opening 15 in the front and rear direction X.

Specifically, the detergent reservoir 310 may have a storage space defined therein for storing the detergent therein, and the ventilation hole 360 communicating the storage space with the outside may be defined in the top face of the detergent reservoir 310. For example, the storage space may be defined in the casing 339 of the detergent reservoir 310, and the ventilation hole 360 may be defined in the cap member 330 of the detergent reservoir 310.

In the ventilation hole 360, a central portion 362 between a lower end 361 facing the storage space and an upper end 363 facing the outside of the detergent reservoir 310 may extend parallel to the top face of the detergent reservoir 310.

The lower end 361 of the ventilation hole 360 is opened to the storage space, and the upper end 363 of the ventilation hole 360 is opened to the outside of the detergent reservoir 310. The ventilation hole 360 may have a shape in which the central portion 362 extends in parallel with the top face of the detergent reservoir 310 as central axes of the upper end 363 and the lower end 361 are spaced apart from each other.

That is, as shown in FIG. 33, the ventilation hole 360 may have a shape in which a center line thereof extending on a cross-section is bent. Accordingly, the situation in which the detergent inside the detergent reservoir 310 leaks to the outside may be effectively suppressed.

Specifically, the detergent reservoir 310 is moved forward and rearward along the detergent opening 15 by the user. In this process, the detergent inside the detergent reservoir 310 may leak to the outside through the ventilation hole 360.

In an embodiment of the present disclosure, as the ventilation hole 360 defines the central portion 362 extending in parallel with the top face of the detergent reservoir 310 between the upper end 363 and the lower end 361 extending in the vertical direction Z, a region in which the storage space and the outside of the detergent reservoir 310 are directly in communication with each other in the vertical direction Z may be minimized. Therefore, the leakage of the detergent outward of the detergent reservoir 310 through the ventilation hole 360 may be minimized.

In one example, as shown in FIG. 33, in an embodiment of the present disclosure, the upper end 363 and the lower end 361 of the ventilation hole 360 may extend in the vertical direction Z of the detergent reservoir 310 and may be connected to the both ends of the central portion 362, respectively.

Thus, a flowing path of the detergent for leaking from the storage space of the detergent reservoir 310 to the outside may be bent several times and the leakage of the detergent may be minimized.

In addition, in an embodiment of the present disclosure, the central portion 362 of the ventilation hole 360 may extend in a direction transverse to the front and rear direction X, for example, in the lateral direction Y of the detergent reservoir 310.

The detergent flowing by the movement of the detergent reservoir 310 may have a momentum in the front and rear direction X like the detergent reservoir 310. Therefore, in an embodiment of the present disclosure, in order to minimize the situation in which the detergent flowing in the front and rear direction X leaks to the outside through the upper end 363 while flowing through the central portion of the ventilation hole 360, the central portion 362 is disposed to extend in the direction transverse to the front and rear direction X, for example, in the lateral direction Y, thereby reducing the leakage of the detergent.

In one example, FIG. 32 illustrates an overlapping region 369 in which the upper end 363 and the lower end 361 of the ventilation hole 360 overlap each other in the vertical direction Z. Referring to FIG. 32, in an embodiment of the present disclosure, in the ventilation hole 360, the upper end 363 and the lower end 361 overlap each other along the vertical direction Z to defined the overlapping region 369 in which the storage space is exposed to the outside.

A scheme of manufacturing the ventilation hole 360 or the cap member 330 of the detergent reservoir 310 having the ventilation hole 360 defined therein may be various. For example, an injection molding scheme using an upper mold corresponding to the upper end 363 of the ventilation hole 360 and a lower mold corresponding to the lower end 361, or a processing scheme in which each of the upper end 363 and the lower end 361 of the ventilation hole 360 are perforated may be used.

In the various schemes as described above, in order to define the ventilation hole 360 according to an embodiment of the present disclosure, a process for defining the central portion 362 extending in parallel with the top face of the detergent reservoir 310 eventually needs to be added. Considering the extending direction and the like of the central portion 362, the process for processing the central portion 362 may be more difficult than other processes.

However, in an embodiment of the present disclosure, as the overlapping region 369 between the upper end 363 and the lower end 361 of the ventilation hole 360 is set, the definition of the central portion 362 may be induced through the processing of the upper end 363 and the lower end 361.

For example, in the injection molding scheme, the upper mold for defining the upper end 363 of the ventilation hole 360 and the lower mold for defining the lower end 361 are arranged to partially overlap each other along the vertical direction Z even though the central axes thereof are spaced apart from each other, so that the ventilation hole 360 according to an embodiment of the present disclosure may be processed.

In addition, also in the perforating scheme, the upper end 363 and the lower end 361 of the ventilation hole 360 are respectively perforated by a certain depth. When the upper end 363 and the lower end 361 are perforated to partially overlap each other, as in an embodiment of the present disclosure, the ventilation hole 360 having the overlapping region 369 may be processed.

As above, in an embodiment of the present disclosure, the central portion 362 in parallel with the top face of the detergent reservoir 310 is defined and the overlapping region 369 in which the upper end 363 and the lower end 361 overlap each other is defined, so that the process for defining the ventilation hole 360 may be effectively and simply improved.

Figure 34:
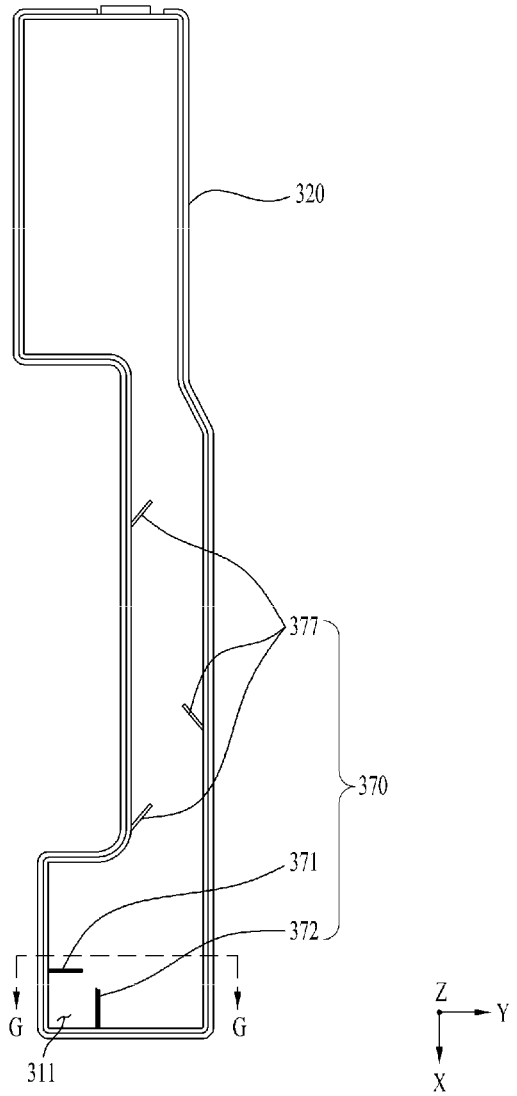
FIG. 34 is a view illustrating an interior of a detergent reservoir in an embodiment of the present disclosure.
Figure 35:
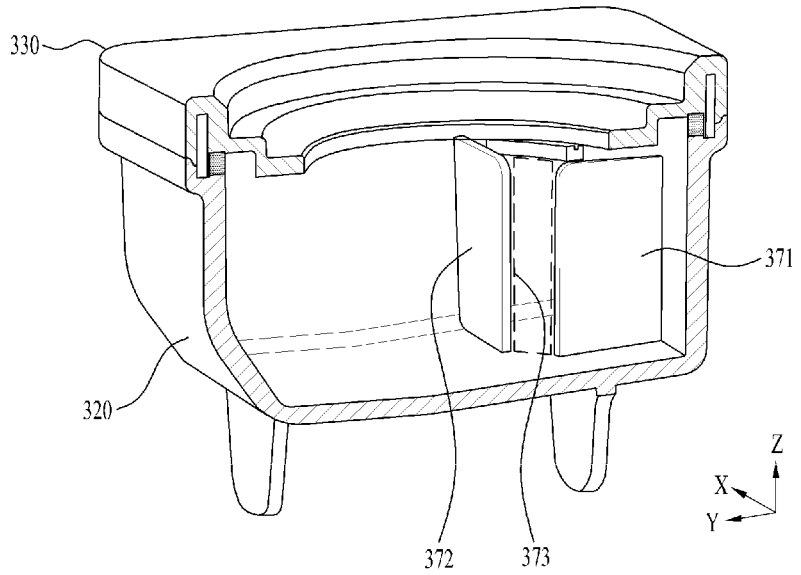
FIG. 35 is a view illustrating a detergent reservoir in FIG. 34 cut along a line G-G.

In one example, FIG. 34 illustrates an interior of the casing 339 of the detergent reservoir 310 in which a plurality of flow inhibiting walls 370 are formed according to an embodiment of the present disclosure, and FIG. 35 is a view illustrating the detergent reservoir 310 in FIG. 34 cut along a line G-G.

Referring to FIGS. 34 and 35, an embodiment of the present disclosure may further include a flow inhibiting wall 370 including a plurality of inhibiting walls arranged in the storage space and protruding from an inner face of the detergent reservoir 310 to inhibit the flow of the detergent toward the ventilation hole 360.

The flow inhibiting wall 370 may be manufactured separately from the casing 339 of the detergent reservoir 310 and coupled to the casing 339, or may be integrally formed with the casing 339. The flow inhibiting wall 370 may include the plurality of inhibiting walls, may be coupled to the inner face of the detergent reservoir 310 to protrude from the inner face, and may suppress the flow of the detergent stored in the detergent reservoir 310.

Kinetic energy of the detergent inside the detergent reservoir 310 may be reduced by the flow inhibiting wall 370. Therefore, it is advantageous that a possibility of the leakage of the detergent through the ventilation hole 360 may be reduced.

In one example, the ventilation hole 360 may be defined at a front end of the top face. The flow inhibiting wall 370 may include a first inhibiting wall 371 positioned rearward of the ventilation hole 360 and extending in the direction transverse to the front and rear direction X. The ventilation hole 360 may be positioned between the front face of the detergent reservoir 310 and the first inhibiting wall 371.

Specifically, the ventilation hole 360 may be defined in the top face of the detergent reservoir 310, for example, at the front end of the cap member 330 of the detergent reservoir 310. As described above, the front end of the detergent reservoir 310 may correspond to the detergent injection portion 313.

The first inhibiting wall 371 may be positioned rearward of the ventilation hole 360. Accordingly, the ventilation hole 360 may be defined between the front face of the detergent reservoir 310 and the first inhibiting wall 371 based on the front and rear direction X. Accordingly, the flow of detergent in the front and rear direction X may be blocked by the front face of the detergent reservoir 310 and the first inhibiting wall 371 and the leakage of the detergent through the ventilation hole 360 may be suppressed.

The first inhibiting wall 371 may extend in the direction transverse to the front and rear direction X. For example, the first inhibiting wall 371 may extend in parallel with the lateral direction Y to block the flow of the detergent in the front and rear direction X. The first inhibiting wall 371 may protrude upward from the bottom face of the detergent reservoir 310 or may extend from the side face of the detergent reservoir 310 in the lateral direction Y.

In one example, as shown in FIGS. 34 and 35, in an embodiment of the present disclosure, the ventilation hole 360 may be positioned at an edge of the front end of the top face to which the side face of the detergent reservoir 310 is connected.

In addition, the flow inhibiting wall 370 may include a second inhibiting wall 372 positioned on an opposite side of the side face around the ventilation hole 360 and extending along the front and rear direction X. The ventilation hole 360 may be positioned between the side face of the detergent reservoir 310 and the second inhibiting wall 372.

As the ventilation hole 360 is positioned at the edge of the front end, the flow of the detergent may be restricted by the front face and side of the detergent reservoir 310 and flow energy of the detergent toward the ventilation hole 360 may be reduced.

In addition, the ventilation hole 360 may be defined between the second inhibiting wall 372 and the side face of the detergent reservoir 310. The second inhibiting wall 372 may extend in parallel with the front and rear direction X. Accordingly, the flow of the detergent toward the ventilation hole 360 along the lateral direction Y may be restricted by the second inhibiting wall 372 and the side face of the detergent reservoir 310.

In one example, in an embodiment of the present disclosure, the first inhibiting wall 371 is connected to the side face and the second inhibiting wall 372 is connected to the front face to partition an edge region 311 in which the ventilation hole 360 is defined in the storage space.

The edge region 311 is shown in FIGS. 34 and 35. In the ventilation hole 360 defined in the edge region 311, the flow of the detergent in both the front and rear direction X and the lateral direction Y may be effectively blocked by the front face and the side face of the detergent reservoir 310, the first inhibiting wall 371, and the second inhibiting wall 372.

Thus, the flow of the detergent inside the detergent reservoir 310 toward the ventilation hole 360 occurred in the retraction and the extension processes of the storage 300 or in other handling processes is blocked in all directions, so that the leakage may be suppressed.

In one example, referring to FIGS. 34 and 35, in an embodiment of the present disclosure, respective sides of the first inhibiting wall 371 and the second inhibiting wall 372 facing each other may be spaced apart from each other, so that an open face 373 of the edge region 311 may be defined.

As the open face 373 is defined between the first inhibiting wall 371 extending from the side face of the detergent reservoir 310 and the second inhibiting wall 372 extending from the front face of the detergent reservoir 310, the edge region 311 and the remaining regions may communicate with each other in the storage space of the detergent reservoir 310.

For example, when respective edges of the first inhibiting wall 371 and the second inhibiting wall 372 are coupled to each other, a communication area between the edge region 311 and the remaining regions becomes too small. Therefore, a flow of air in the storage space through the ventilation hole 360 may be restricted, thereby deteriorating a function of the ventilation hole 360.

Thus, in an embodiment of the present disclosure, the open face 373 is defined between the first inhibiting wall 371 and the second inhibiting wall 372, and a flow of a portion of the detergent is allowed together with the flow of the air through the open face 373, so that the use of the entire storage space may be facilitated and the function of the ventilation hole 360 may be maintained.

Figure 36:
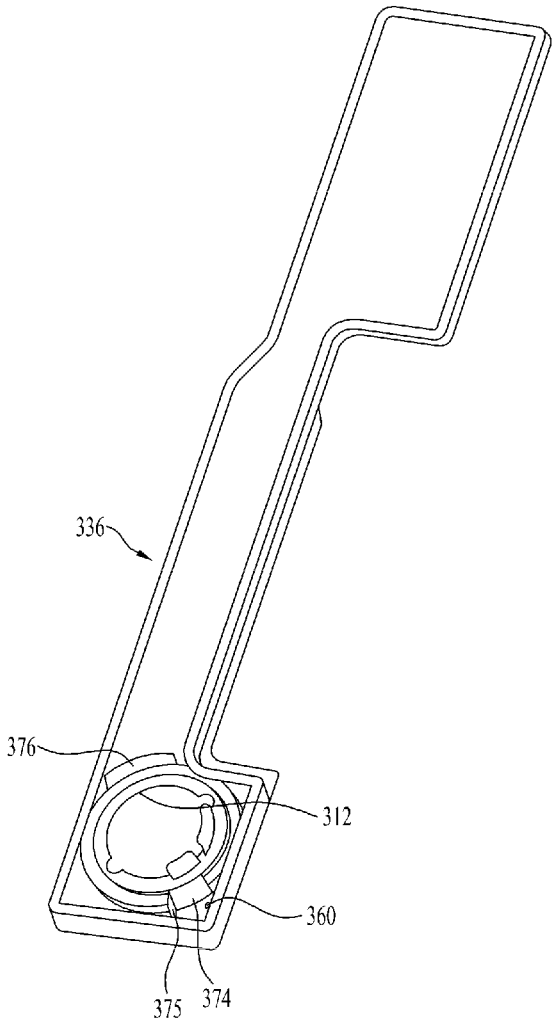
FIG. 36 is a view illustrating a bottom face of a cap member in an embodiment of the present disclosure.
Figure 37:
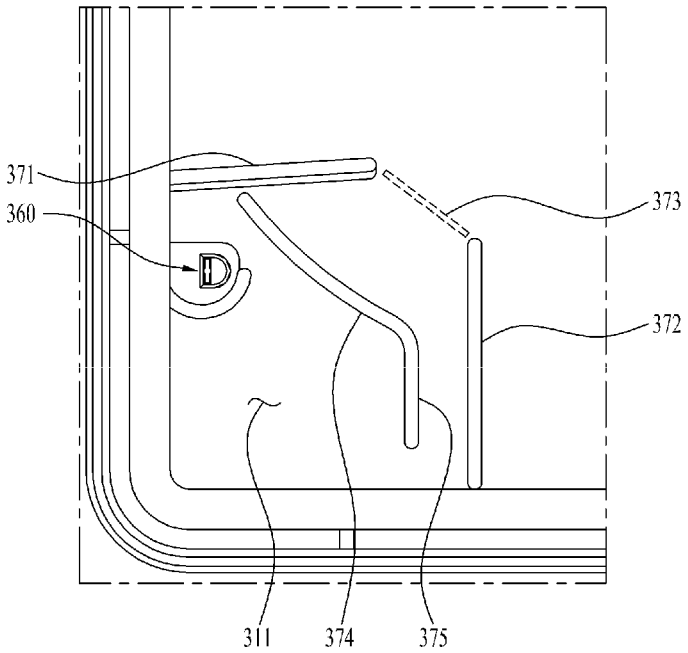
FIG. 37 is a view illustrating an edge region of a detergent reservoir in an embodiment of the present disclosure.

In one example, FIG. 36 illustrates a third inhibiting wall 374 and a fourth inhibiting wall 376 according to an embodiment of the present disclosure, and FIG. 37 illustrates a state in which the third inhibiting wall 374, the first inhibiting wall 371, and the second inhibiting wall 372 are arranged together.

Referring to FIGS. 36 and 37, an embodiment of the present disclosure may further include the third inhibiting wall 374 positioned closer to the ventilation hole 360 than the first inhibiting wall 371 and the second inhibiting wall 372 and having one face disposed to face the open face 373.

The third inhibiting wall 374 may be positioned within the edge region 311 that may be defined by the first inhibiting wall 371 and the second inhibiting wall 372. That is, the third inhibiting wall 374 may be positioned closer to the ventilation hole 360 than the first inhibiting wall 371 and the second inhibiting wall 372, and said one face of the third inhibiting wall 374 may be disposed to extend in parallel with the open face 373 and face the open face 373.

That is, the third inhibiting wall 374 may be disposed to reduce the flow energy of detergent flowing through the open face 373 in the edge region 311. As described above, while defining the open face 373 to secure the flow of the detergent and the air, the third inhibiting wall 374 may be disposed to block the flow of the detergent again in order to prevent the detergent from leaking through the ventilation hole 360 as the flow energy of the detergent introduced through the open face 373 is too high.

In one example, referring to FIGS. 36 and 37, in an embodiment of the present disclosure, the third inhibiting wall 374 may include an extended face 375 extending from said one face and extending in parallel with the first inhibiting wall 371 or the second inhibiting wall 372 while facing the first inhibiting wall 371 or the second inhibiting wall 372.

Specifically, in the third inhibiting wall 374, the extended face 375 extending from said one face facing the open face 373 of the edge region 311 may extend in parallel with the first inhibiting wall 371 or the second inhibiting wall 372.

The extended face 375 may be extended along the first inhibiting wall 371 or along the second inhibiting wall 372 from the third inhibiting wall 374, and may include a pair of extended faces to respectively correspond to the first inhibiting wall 371 and the second inhibiting wall 372.

As the third inhibiting wall 374 has the extended face 375, a limited flow path through which the detergent and the air may flow may be defined between the extended face 375 and the first inhibiting wall 371 or the second inhibiting wall 372, and the flow energy of the detergent may be further reduced through the limited flow path.

In one example, FIG. 34 illustrates the first inhibiting wall 371 and the second inhibiting wall 372 protruding from the bottom face of the detergent reservoir 310, and FIG. 36 illustrates the third inhibiting wall 374 protruding from the top face of the detergent reservoir 310.

As in FIGS. 34 and 36, in an embodiment of the present disclosure, the first inhibiting wall 371 and the second inhibiting wall 372 protrude from the bottom face of the detergent reservoir 310, and protruding ends of the first inhibiting wall 371 and the second inhibiting wall 372 are spaced apart from the top face of the detergent reservoir 310. The third inhibiting wall 374 may protrude from the top face, and a protruding end thereof may be spaced apart from the bottom face.

The first inhibiting wall 371 and the second inhibiting wall 372 may protrude upward from the bottom face of the casing 339 of the detergent reservoir 310, and the third inhibiting wall 374 may protrude downward from the cap member 330 of the detergent reservoir 310.

In other words, by design or manufacturing tolerances, upper ends of the first inhibiting wall 371 and the second inhibiting wall 372 may be spaced apart from the cap member 330 and a lower end of the third inhibiting wall 374 may be spaced apart from the bottom face of the detergent reservoir 310.

Accordingly, the detergent flowing in the edge region 311 may be partially allowed to flow beyond the upper ends of the first inhibiting wall 371 and the second inhibiting wall 372 or flow beyond the lower end of the third inhibiting wall 374. However, because the flow path is formed to be bent in a zigzag shape in the vertical direction Z, the detergent may flow in the state in which the flow energy is reduced.

In one example, as described above, in an embodiment of the present disclosure, the detergent reservoir 310 may include the detergent injection portion 313, the detergent discharge portion 317, and the connection portion 315. Further, the storage space of the detergent reservoir 310 may extend from the detergent injection portion 313 to the detergent discharge portion 317 through the connection portion 315.

In addition, referring to FIGS. 31 and 36, an embodiment of the present disclosure may further include the fourth inhibiting wall 376, and the fourth inhibiting wall 376 may be disposed so as to face the connection portion 315 in the detergent injection portion 313 and may extend in the direction transverse to the front and rear direction X.

The fourth inhibiting wall 376 may inhibit the flow of the detergent between the detergent injection portion 313 and the connection portion 315. The fourth inhibiting wall 376 may protrude downward from the cap member 330 and may be disposed on the detergent injection portion 313 to face the connection portion 315.

The fourth inhibiting wall 376 may extend in the direction transverse to the front and rear direction X. For example, the fourth inhibiting wall 376 may extend in the lateral direction Y, and may extend along an edge of the detergent injection hole 312 while forming a curved face as shown in FIG. 36.

Referring to FIG. 34 again, an embodiment of the present disclosure may further include a fifth inhibiting wall 377. The fifth inhibiting wall 377 may be disposed in the connection portion 315 and may extend to transverse the front and rear direction X.

The fifth inhibiting wall 377 may be disposed in the casing 339 of the detergent reservoir 310, and may inhibit the detergent from flowing in the front and rear direction X from the connection portion 315 extending along the front and rear direction X. In addition, the fifth inhibiting wall 377 may be connected to a side face of the connection portion 315, and rearwardly extend in a direction to be further away from the side face of the connection portion 315.

That is, the fifth inhibiting wall 377 may be inclined rearwards as the fifth inhibiting wall 377 extends along the lateral direction Y. Accordingly, the fifth inhibiting wall 377 may more effectively inhibit the detergent from flowing forward as the storage 300 moves.

Figure 38:
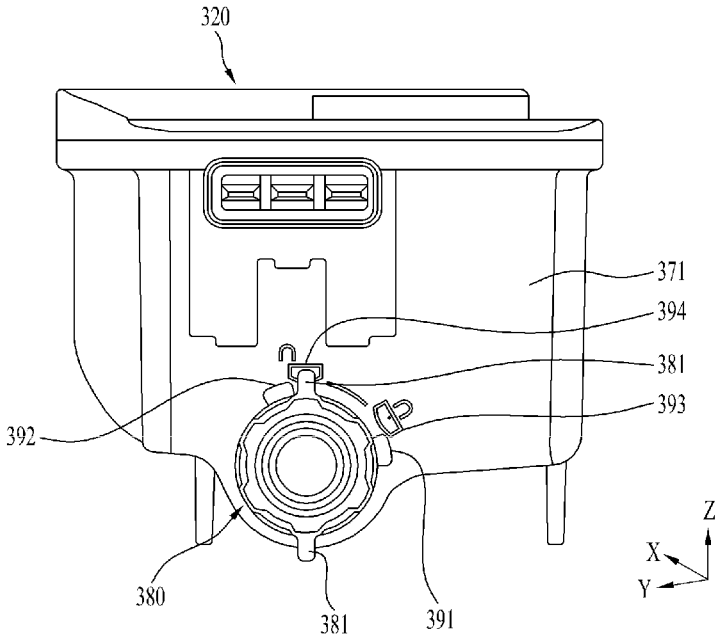
FIG. 38 is a view viewed from rearward of a detergent reservoir in an embodiment of the present disclosure.
Figure 39:
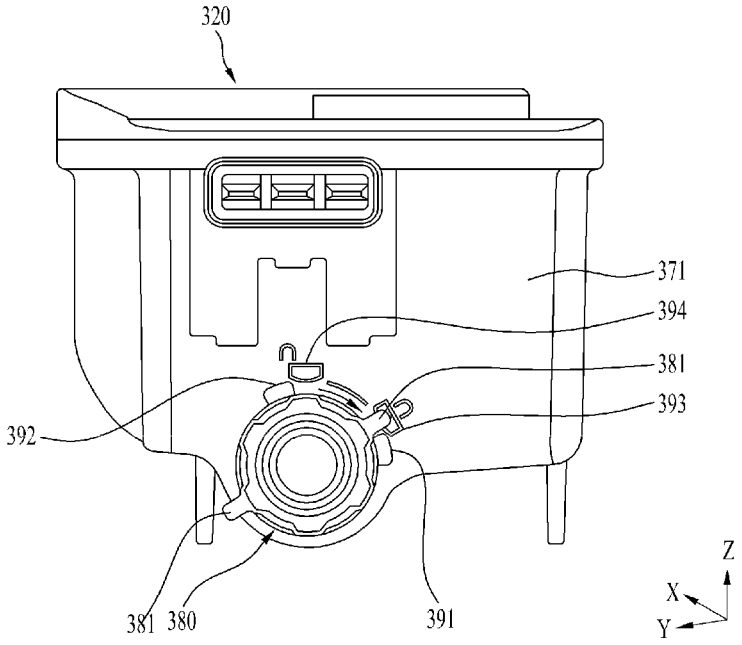
FIG. 39 illustrates a state in which a detergent valve in FIG. 38 is rotated in a closed state.

In one example, FIG. 38 illustrates the detergent valve 380 coupled to the rear face of the detergent reservoir 310 according to an embodiment of the present disclosure, and FIG. 39 illustrates a state in which the detergent valve 380 in FIG. 38 is rotated in a closed state by the coupling.

Referring to FIGS. 38 and 39, an embodiment of the present disclosure includes the detergent valve 380 inserted into and coupled to a valve hole 397 defined in the rear face of the detergent reservoir 310, and the detergent valve 380 is rotated by a predetermined amount in a forward direction in the valve hole 397 to be coupled to the valve hole 397.

In addition, the detergent valve 380 may include a restriction protrusion 381 protruding in a radial direction of the detergent valve 380 from a rear end 382 thereof protruding rearward of the detergent reservoir 310. An embodiment of the present disclosure may further include a forward stopper 391 protruding rearward from the rear face of the detergent reservoir 310 and positioned at a position along a forward path of the restriction protrusion 381 on a rotation path of the restriction protrusion 381.

In the state in which the detergent valve 380 is rotated by the predetermined amount, the restriction protrusion 381 may be in contact with the forward stopper 391, so that the rotation of the restriction protrusion 281 may be restricted.

Specifically, the detergent valve 380 is coupled to the detergent reservoir 310 and serves as means for discharging the detergent in the detergent reservoir 310 to the outside. As will be described below, when the storage 300 is completely retracted into the detergent opening 15 in the state in which the flow of the detergent is blocked, the detergent valve 380 may be pressurized by an inlet port 426 of the detergent pump and may be in an open state of allowing the flow of the detergent.

The detergent valve 380 may be inserted into the valve hole 397 defined in the rear face of the detergent reservoir 310. The detergent valve 380 inserted into the valve hole 397 may be coupled to the valve hole 397 in a closed state in which separation from the valve hole 397 is restricted as the detergent valve 380 rotates in the forward direction.

FIG. 38 illustrates the detergent valve 380 that is inserted into the valve hole 397 and is in the open state, which is a state before the detergent valve 380 is rotated in the closed state. FIG. 39 illustrates a state in which the detergent valve 380 is rotated by a certain amount in the forward direction from the open state in FIG. 38 to be in the closed state.

The detergent valve 380 may be in the closed state when the detergent valve 380 is rotated by the certain amount in said one direction. As for a coupling scheme based on such rotation, a screw coupling scheme, an insertion fastening scheme of a protrusion and a groove as will be described below, and the like may be used.

In one example, in the state in which the detergent valve 380 is inserted into the valve hole 397, the rear end 382 may be exposed by protruding rearward of the detergent reservoir 310. Further, the restriction protrusion 381 protruding along a radial direction of the detergent valve 380 may be disposed at the rear end 382 of the detergent valve 380.

The number of restriction protrusions 381 may vary. FIGS. 38 and 39 illustrate a state in which two restriction protrusions 381 are positioned on opposite sides of each other according to an embodiment of the present disclosure.

In order to rotate the detergent valve 380 as necessary, the user may grip and rotate the detergent valve 380 using the restriction protrusion 381 or a grip groove 384 defined at the rear end 382 of the detergent valve 380 as will be described below.

In one example, the forward stopper 391 may be disposed on the rear face of the detergent reservoir 310. The forward stopper 391 may protrude rearward from the rear face of the detergent reservoir 310, and may be positioned on the rotation path of the restriction protrusion 381 along the forward direction.

In the open state, the restriction protrusion 381 of the detergent valve 380 and the forward stopper 391 may be spaced apart from each other by a certain amount of rotation angle to be in the closed state.

That is, when the detergent valve 380 inserted into the valve hole 397 is rotated by the certain amount in the forward direction, the restriction protrusion 381 may be brought into contact with the forward stopper 391, so that the rotation of the restriction protrusion 381 may be restricted. Accordingly, even when the user rotates the detergent valve 380 for the closed state of the detergent valve 380, because excessive rotation may be prevented by the forward stopper 391, damage or breakage of the detergent valve 380 or other components may be prevented.

Figure 40:
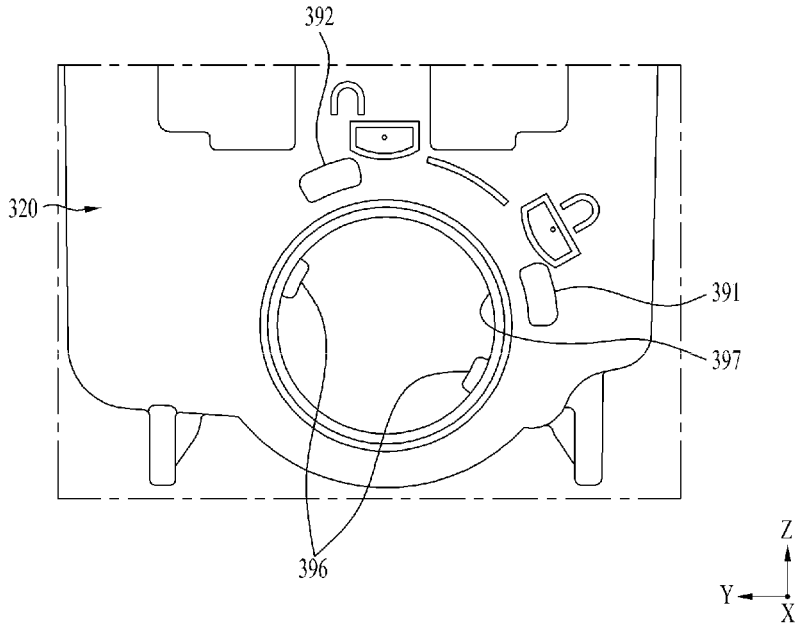
FIG. 40 is a view illustrating a valve hole of a detergent reservoir in an embodiment of the present disclosure.
Figure 41:
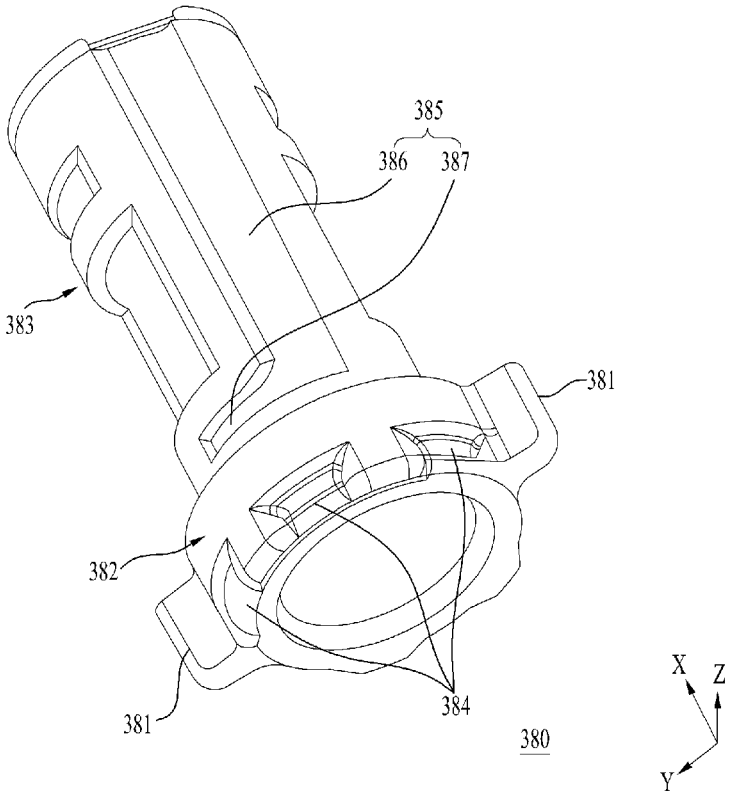
FIG. 41 is a view illustrating a detergent valve in an embodiment of the present disclosure.

In one example, FIG. 40 illustrates the valve hole 397 into which the detergent valve 380 is inserted and a coupling protrusion 396, and FIG. 41 illustrates a coupling groove 385 defined in the detergent valve 380.

Referring to FIGS. 40 and 41, in an embodiment of the present disclosure, the detergent reservoir 310 includes the coupling protrusion 396 on an inner circumferential face of the valve hole 397. The detergent valve 380 may have the coupling groove 385 defined in an outer circumferential face thereof through which the coupling protrusion 396 slides and is fixed.

The coupling protrusion 396 may protrude toward the detergent valve 380 from the inner circumferential face of the valve hole 397. A shape and the number of coupling protrusions 396 may vary. FIG. 40 illustrates a state in which two coupling protrusions 396 are positioned on opposite sides of each other according to an embodiment of the present disclosure. The coupling groove 385 may be defined in the outer circumferential face of the detergent valve 380, and the coupling protrusion 396 may be slid and fixed in the coupling roove 385.

Accordingly, as the detergent valve 380 is inserted into the valve hole 397, the coupling protrusion 396 disposed in the valve hole 397 is inserted into the coupling groove 385. As the detergent valve 380 rotates in the forward direction, the coupling protrusion 396 moves to an extended end of the coupling groove 385. When the coupling protrusion 396 reaches the end of the coupling groove 385, the closed state may be implemented while the rotation is restricted.

In this case, when the detergent valve 380 rotates excessively along the forward direction, the coupling protrusion 396 may be damaged or the coupling groove 385 may be damaged. Accordingly, the separation or the rotation of the detergent valve 380 may become impossible or recoupling may become difficult.

An embodiment of the present disclosure includes the restriction protrusion 381 on the detergent valve 380 and the forward stopper 391 on the detergent reservoir 310, so that the rotation restriction by the restriction protrusion 381 and the forward stopper 391 is implemented in addition to the rotation restriction based on a relationship between the coupling protrusion 396 and the coupling groove 385, thereby preventing the damage to the coupling groove 385 or the coupling protrusion 396.

In one example, in an embodiment of the present disclosure, the detergent valve 380 includes an insertion portion 383 in front of the rear end 382 protruding rearward of the detergent reservoir 310. The insertion portion 383 may be inserted into the detergent reservoir 310, and the coupling groove 385 may be defined in an outer circumferential face of the insertion portion 383.

Thus, in the insertion process of the detergent valve 380, the coupling protrusion 396 of the valve hole 397 may be inserted and slid into the coupling groove 385 of the insertion part 383, and the rear end 382 may be exposed to the outside and be held by the user. An extension shape of the coupling groove 385 may be various, and an indented shape thereof may correspond to the coupling protrusion 396.

In one example, in an embodiment of the present disclosure, the rear end 382 of the detergent valve 380 may have a larger diameter than the insertion portion 383, and a front face thereof may be supported on the rear face of the detergent reservoir 310.

In the detergent valve 380, the rear end 382 may have the larger diameter than the insertion portion 383. That is, the detergent valve 380 may be formed such that the rear end 382 is stepped with respect to the insertion portion 383, and accordingly, an insertion distance of the detergent valve 380 may be restricted.

In addition, because the front face of the rear end 382 is supported on the rear face of the detergent reservoir 310, a stable fixing structure of the detergent valve 380 may be implemented.

In one example, in an embodiment of the present disclosure, the rear end 382 of the detergent valve 380 may have a plurality of grip grooves 384 spaced apart from each other along an outer circumferential direction. The rear end 382 of the detergent valve 380 may be exposed to the outside of the detergent reservoir 310, and the grip grooves 384 may be defined to be easily gripped by the user.

The user may rotate the detergent valve 380 in the forward or the reverse direction by gripping not only the restriction protrusion 381, but also the rear end 382 itself in which the grip grooves 384 are defined.

In one example, in an embodiment of the present disclosure, the coupling groove 385 may include a straight-movement portion 386 and a rotation portion 387. A front face of a front end of the straight-movement portion 386 may be opened forward, and the straight-movement portion 386 may extend rearward from the front end. The rotation portion 387 may extend in the reverse direction, which is opposite to the forward direction, from a rear end of the straight-movement portion 386.

The detergent valve 380 may be inserted into the valve hole 397 such that the coupling protrusion 396 slides in the straight-movement portion 386. The coupling protrusion 396 may be rotated in the forward direction so as to slide in the rotation portion 387 to be coupled to the valve hole 397.

A detailed description of the coupling process of the detergent valve 380 based on the shape of the coupling groove 385 as described above is as follows.

Figure 42:
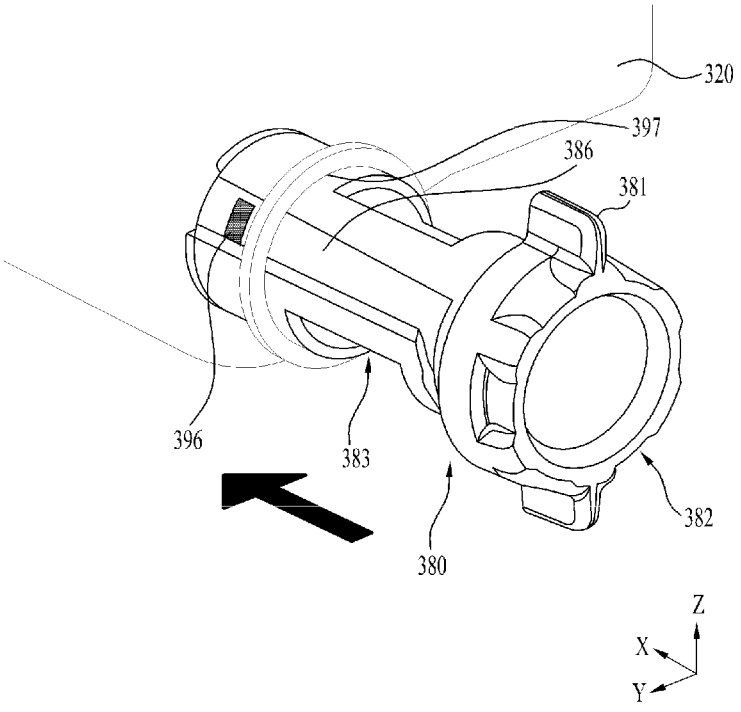
FIG. 42 is a view illustrating a detergent valve inserted into a valve hole in an embodiment of the present disclosure.

First, FIG. 42 illustrates the detergent valve 380 that begins to be inserted into the valve hole 397. The detergent valve 380 may be inserted into the valve hole 397 in a state in which the straight-movement portion 386 of the coupling groove 385 and the coupling protrusion 396 are aligned to be positioned on a straight line in the front and rear direction X. In this process, the coupling protrusion 396 may slide along the straight-movement portion 386 of the coupling groove 385.

Figure 43:
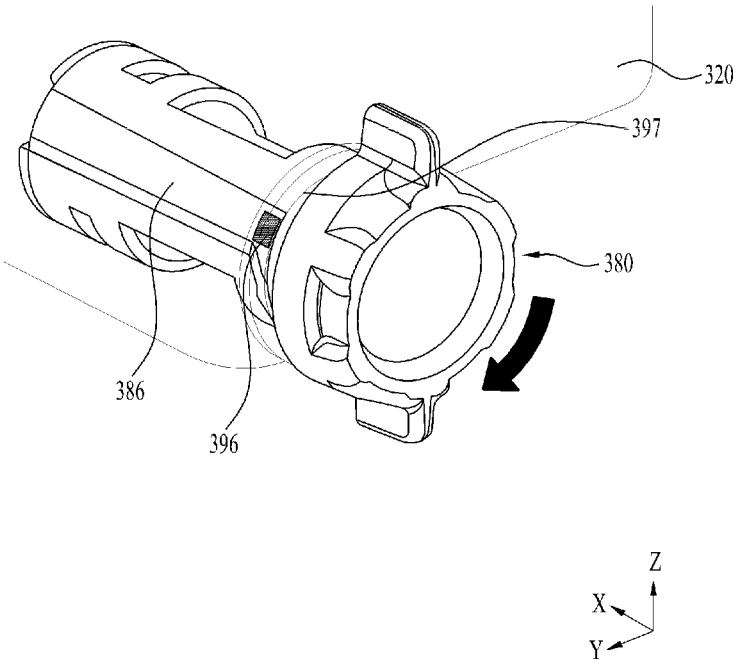
FIG. 43 is a view illustrating a state in which a detergent valve in FIG. 42 is inserted into a valve hole in an open state.

In one example, FIG. 43 illustrates a state in which the detergent valve 380 in FIG. 42 is completely inserted into the valve hole 397. The detergent valve 380 may move straight such that the front face of the rear end 382 is in contact with the rear face of the detergent reservoir 310, so that the detergent valve 380 may be inserted into the valve hole 397. In this state, the coupling protrusion 396 may still be positioned in the straight-movement portion 386 of the coupling groove 385.

Figure 44:
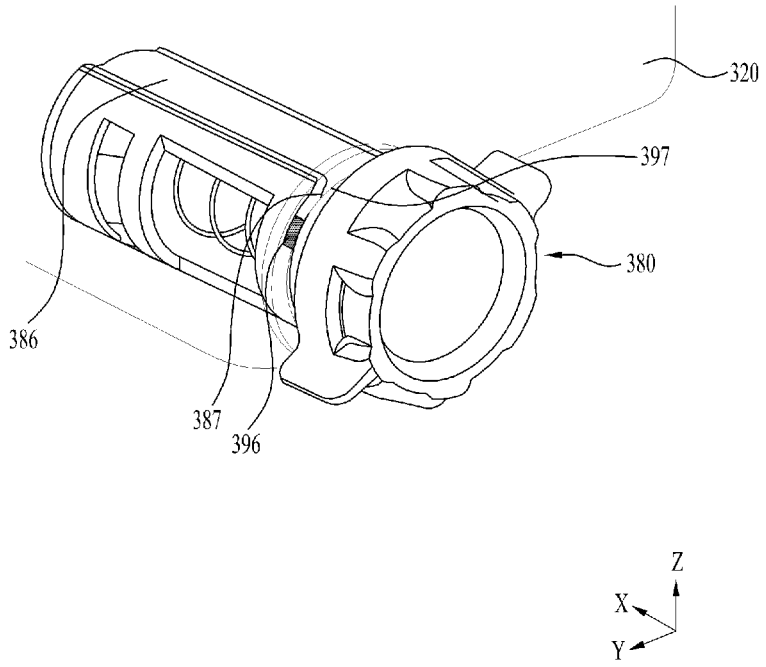
FIG. 44 is a view illustrating a state in which a detergent valve in FIG. 43 is rotated in a closed state.

In one example, FIG. 44 illustrates a state in which the detergent valve 380 in FIG. 43 is rotated in the forward direction and is in the closed state. The detergent valve 380 may be rotated in the forward direction in a state in which the detergent valve 380 is completely inserted such that the front face of the rear end 382 is in contact with the rear face of the detergent reservoir 310.

When the detergent valve 380 is rotated in the forward direction, the coupling protrusion 396 may move along the rotation portion 387 from the straight-movement portion 386 of the coupling groove 385. As the detergent valve 380 is rotated in the forward direction, the coupling protrusion 396 is moved in the reverse direction with respect to the detergent valve 380, so that the rotation portion 387 may extend in the reverse direction from the straight-movement portion 386.

A length of the rotation portion 387 may correspond to the certain amount of rotation in the forward direction for the detergent valve 380 to be in the closed state. That is, when the detergent valve 380 is rotated in the forward direction and the coupling protrusion 396 is positioned at an end of the rotation portion 387 of the coupling groove 385, the detergent valve 380 becomes in the closed state and the coupling process is terminated.

In one example, in an embodiment of the present disclosure, the straight-movement portion 386 may extend rearward from the front end of the detergent valve 380, and the opened front face may be positioned on the front face of the detergent valve 380.

Accordingly, when the straight-movement portion 386 and the coupling protrusion 396 are not aligned on the straight line, the detergent valve 380 may be restricted from being inserted into the valve hole 397, and the user may effectively identify a current alignment state of the detergent valve 380.

For example, when the open front face of the straight-movement portion 386 is spaced rearwardly apart from the front face of the detergent valve 380, the detergent valve 380 is not able to be inserted further as the coupling protrusion 396 and the coupling groove 385 are not aligned with each other in a state in which the detergent valve 380 is partially inserted into the valve hole 397. In this case, it may not be easy for the user to identify the alignment state of the coupling protrusion 396 and the coupling groove 385.

Thus, an embodiment of the present disclosure may allow the insertion of the detergent valve 380 to be performed while the user easily identifies the alignment state between the coupling protrusion 396 and the coupling groove 385 with the naked eye from the beginning of the insertion of the detergent valve 380.

In one example, referring to FIGS. 43 and 44, in an embodiment of the present disclosure, the forward stopper 391 may be in contact with the restriction protrusion 381 when the coupling protrusion 396 is positioned at the end of the rotation portion 387.

As described above, the contact between the restriction protrusion 381 and the forward stopper 391 may assist in restricting the rotation by the coupling protrusion 396 and the coupling groove 385. Accordingly, when the coupling protrusion 396 is positioned at the end of the rotation portion 387 in the coupling groove 385, as the rotation of the restriction protrusion 381 is restricted by the forward stopper 391, further rotation may be prevented and the damage to the coupling protrusion 396 and the like may be prevented.

Figure 45:
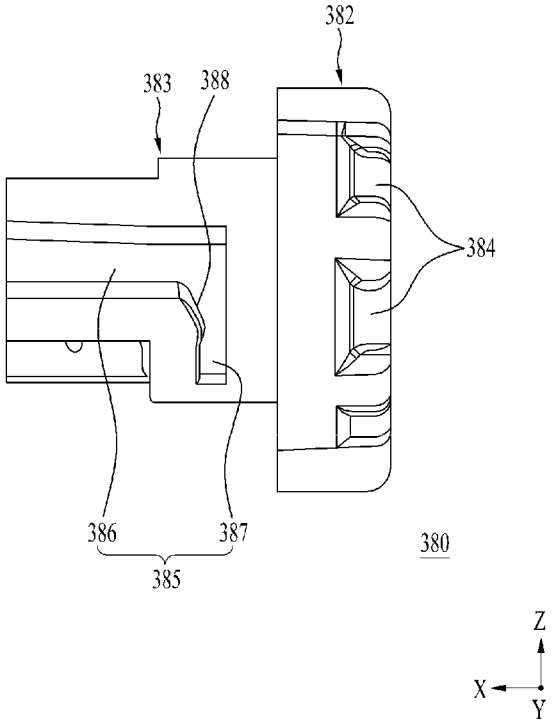
FIG. 45 is a view illustrating a coupling groove of a detergent valve in an embodiment of the present disclosure.

In one example, FIG. 45 illustrates the rear end 382 of the detergent valve 380 and the rotation portion 387 of the coupling groove 385 according to an embodiment of the present disclosure.

Referring to FIG. 45, in an embodiment of the present disclosure, in the rotation portion 387, an entry portion 388 is defined between the rear end of the straight-movement portion 386 and the end of the rotation portion 387. The entry portion 388 may be defined to have a smaller width than the end of the rotation portion 387.

The entry portion 388 may be defined in the rotation portion 387. That is, the entry portion 388 may be defined at a position of the rotation portion 387 connected to the straight-movement portion 386. In addition, the entry portion 388 may be defined to have a smaller width than the rotation portion 387. Thus, in a process in which the coupling protrusion 396 passes through the entry portion 388, a resistance to the movement may be generated.

By the entry portion 388, the user may feel the resistance to the rotation at the beginning of the rotation of the detergent valve 380, and may recognize that the coupling protrusion 396 has completely entered the rotation portion 387 based on the rotation in the forward direction of the detergent valve 380.

In addition, when the coupling protrusion 396 is positioned at the end of the rotation portion 387, and when the detergent valve 380 is rotated in the reverse direction due to an unintended cause, the entry portion 388 interferes the movement of the coupling protrusion 396. Thus, it is possible to prevent the detergent valve 380 from being unintentionally rotated in the reverse direction and being converted into the open state.

In one example, referring to FIG. 45, a side face of the entry portion 388 may be formed to be inclined such that a width thereof decreases toward the end of the rotation portion 387. That is, the entry portion 388 may be formed such that a width thereof decreases in a direction away from the straight-movement portion 386.

The side face inclined in the entry portion 388 may be flat or curved. In addition, an end of the entry portion 388 facing the rotation portion 387 may have a stepped shape in which the width discontinuously increases in a relationship with the rotation portion 387.

In an embodiment of the present disclosure, by the entry portion 388 defined such that the side face thereof is inclined, when the detergent valve 380 rotates in the forward direction, the coupling protrusion 396 may be induced to enter the rotation portion 387. In addition, when the detergent valve 380 is unintentionally rotated in the reverse direction, the movement of the coupling protrusion 396 may be restricted by the entry portion 388.

Referring to FIGS. 38 and 39 again, an embodiment of the present disclosure may further include a reverse stopper 392. The reverse stopper 392 may protrude rearward from the rear face of the detergent reservoir 310, and may be positioned at a position along a reverse path of the restriction protrusion 381 on the rotation path of the restriction protrusion 381.

That is, an embodiment of the present disclosure restricts the amount of the rotation in the forward direction of the detergent valve 380 to be equal to or less than the certain amount through the forward stopper 391, and at the same time, prevents over-rotation of the detergent valve 380 using the reverse stopper 392 also in the rotation in the reverse direction of the detergent valve 380 for the open state, thereby preventing the damage to the coupling protrusion 396 and the like.

In one example, in an embodiment of the present disclosure, when the coupling protrusion 396 is positioned in the straight-movement portion 386, the restriction protrusion 381 is brought into contact with the reverse stopper 392, so that the rotation in the reverse direction may be restricted.

In the rotation in the reverse direction of the detergent valve 380 to be in the open state from the closed state, the coupling protrusion 396 moves from the end of the rotation portion 387 toward the straight-movement portion 386. When the coupling protrusion 396 enters the straight-movement portion 386, the reverse stopper 392 restricts the rotation in the reverse direction of the restriction protrusion 381, thereby preventing the coupling protrusion 396 from being pressed and damaged by the side face of the straight-movement portion 386.

In one example, in an embodiment of the present disclosure, a closing mark 393 may be imprinted at a position corresponding to the forward stopper 391 and an open mark 394 may be imprinted at a position corresponding to the reverse stopper 392 on the rear face of the detergent reservoir 310.

The closing mark 393 and the open mark 394 may be various. For example, a word representing opening and closing may be imprinted in Korean or English, or a specific shape such as an open lock, a closed lock, and the like may be imprinted as shown in FIGS. 38 and 39. A scheme of the imprinting may also be various, such as engraving or embossing.

In the state in which the detergent valve 380 is inserted, the forward direction for the closed state of the detergent valve 380 or the reverse direction for the open state may be ambiguous to the user. Accordingly, an embodiment of the present disclosure includes the forward stopper 391 and the reverse stopper 392 that restrict the rotation of the restriction protrusion 381 and imprints the closing mark 393 and the open mark 394 respectively on or around the forward stopper 391 and the reverse stopper 392, so that it is possible to effectively recognize the forward or reverse direction and the open or closed state resulted therefrom to the user.

Figure 46:
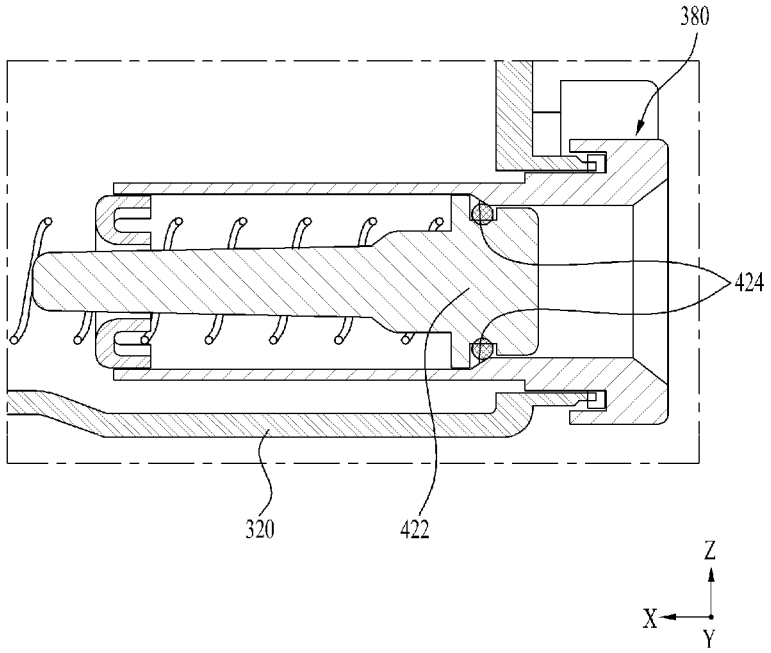
FIG. 46 is a view illustrating a cross-section of a detergent valve coupled to a valve hole in an embodiment of the present disclosure.
Figure 47:
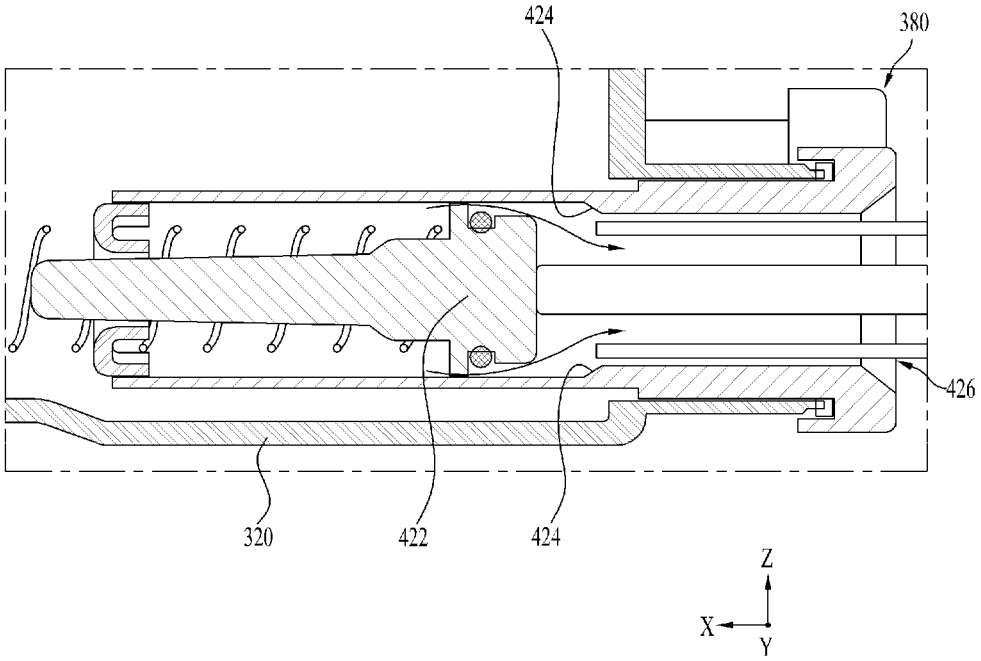
FIG. 47 is a view illustrating a state in which a detergent valve in FIG. 46 is coupled to an inlet port of a detergent pump.

In one example, FIG. 46 illustrates an internal cross-section of the detergent valve 380 according to an embodiment of the present disclosure, and FIG. 47 illustrates a state in which the inlet port 426 of the detergent pump is coupled to the detergent valve 380 according to an embodiment of the present disclosure.

Referring to FIGS. 46 and 47, in an embodiment of the present disclosure, when the detergent reservoir 310 is retracted into the detergent opening 15, the detergent valve 380 may be connected to the detergent pump installed inside the cabinet 10.

FIG. 46 is a view illustrating a state before the detergent reservoir 310 is retracted into the detergent opening 15, and FIG. 47 is a view illustrating a state in which the detergent reservoir 310 is completely retracted into the detergent opening 15.

The detergent reservoir 310 may slide inside the detergent opening 15 in a state of being coupled to the storage frame 390, and the inlet port 426 of the detergent pump may be positioned rearward of the detergent opening 15.

The inlet port 426 may be positioned to correspond to the detergent valve 380 in the front and rear direction X. Therefore, as the retraction of the storage 300 is terminated, the inlet port 426 may be connected to the detergent valve 380.

In one example, in an embodiment of the present disclosure, the detergent valve 380 may include a valve housing, a valve head 422, and an elastic member.

A space in which the valve head 422 and the elastic member are arranged may be defined inside the valve housing, and the valve head 422 may be pressed by the elastic member to be in close contact with the valve housing and shield the valve.

Specifically, the elastic member may be disposed inside the valve housing to pressurize the valve head 422 rearward. The valve head 422 may be pressed rearward to be in close contact with a valve support face 424 of the valve housing.

Referring to FIG. 46, the valve support face 424 is disposed to surround a rearward opening of the valve housing. When the valve head 422 is in close contact with the valve support face 424, as the rearward opening of the valve housing is shielded, the flow of the detergent may be restricted.

In one example, as shown in FIG. 47, when the detergent reservoir 310 is completely retracted into the detergent opening 15, the inlet port 426 of the detergent pump forwardly pressurizes the valve head 422. The valve head 422 pressed by the inlet port 426 is moved forward and spaced apart from the valve support face 424. Accordingly, a rearward opening of the valve cabinet 10 is opened by a separation space between the valve support face 424 and the valve head 422.

When the rearward opening is opened, the detergent in the detergent reservoir 310 becomes to be in a state capable of moving toward the inlet port 426 of the detergent pump. Based on an operating state of the detergent pump, the detergent in the detergent reservoir 310 may flow toward the detergent pump.

Although the present disclosure has been illustrated and described in connection with a specific embodiment, it will be apparent to those of ordinary skill in the art that the present disclosure may be variously improved and changed without departing from the technical idea of the present disclosure provided by the following claims.

What is claimed is:

1. A laundry treating apparatus comprising:

a cabinet defining a detergent opening at a front face of the cabinet;

a tub received in the cabinet;

a drum configured to rotate inside the tub; and a detergent reservoir configured to receive a detergent and be inserted into the cabinet through the detergent opening along a first direction that extends between the front face of the cabinet and a rear face of the cabinet opposite to the front face of the cabinet, wherein the detergent reservoir defines a storage space configured to receive the detergent, and further defines a ventilation hole configured to allow fluid communication between the storage space and an exterior of the detergent reservoir, wherein the ventilation hole is located at a front side of the detergent reservoir that is positioned closer to a front face of the detergent reservoir than to a rear face of the detergent reservoir, wherein the laundry treating apparatus further includes:

a plurality of walls protruding from an inner face of the detergent reservoir and disposed in the storage space, the plurality of walls being configured to restrict flow of the detergent toward the ventilation hole, wherein the plurality of walls includes a first wall located at the front side of the detergent reservoir and a rear of the ventilation hole, the first wall extending in a second direction transverse to the first direction, and wherein the ventilation hole is located between the front face of the detergent reservoir and the first wall.

2. The laundry treating apparatus of claim 1, wherein the ventilation hole is located closer to a first side face of the detergent reservoir than to a second side face of the detergent reservoir opposite to the first side face of the detergent reservoir, wherein the plurality of the walls further includes a second wall located at an opposite side of the first side face with respect to the ventilation hole, wherein the second wall extends in the first direction, and wherein the ventilation hole is located between the first side face of the detergent reservoir and the second wall.

3. The laundry treating apparatus of claim 2, wherein the first wall is connected to the first side face of the detergent reservoir and the second wall is connected to the front face of the detergent reservoir, wherein the first wall and the second wall define an edge region in which the ventilation hole is located in the storage space.

4. The laundry treating apparatus of claim 3, wherein respective ends of the first wall and the second wall that face each other are spaced apart from each other and define a gap therebetween that is configured to allow fluid communication between the edge region and a remaining region of the storage space of the detergent reservoir.

5. The laundry treating apparatus of claim 4, wherein the plurality of the walls further includes a third wall that is positioned closer to the ventilation hole than the first wall and the second wall are and that faces the gap of the edge region.

6. The laundry treating apparatus of claim 5, wherein the third wall includes an extended face extending from the first side face of the detergent reservoir, and wherein the extended face is extended in parallel with the first wall or the second wall.

7. The laundry treating apparatus of claim 5, wherein the first wall and the second wall protrude from a bottom face of the detergent reservoir, and respective top ends of the first wall and the second wall are spaced apart from a top face of the detergent reservoir, and wherein the third wall protrudes from the top face of the detergent reservoir, and a bottom end of the third wall is spaced from the bottom face of the detergent reservoir.

8. The laundry treating apparatus of claim 5, wherein the detergent reservoir includes:

a detergent injection portion located at the front side of the detergent reservoir and defining the ventilation hole;

a detergent discharge portion located at a rear side of the detergent reservoir and constructed to discharge the detergent, the rear side of the detergent reservoir being opposite to the front side of the detergent reservoir along the first direction; and a connection portion that connects the detergent injection portion with the detergent discharge portion, wherein the storage space extends from the detergent injection portion to the detergent discharge portion through the connection portion, wherein the plurality of the walls further includes a fourth wall that is disposed at the detergent injection portion and faces the connection portion, and wherein the fourth wall extends in the second direction.

9. The laundry treating apparatus of claim 8, wherein the plurality of the walls further includes a fifth wall disposed at the connection portion, and wherein the fifth wall extends in the second direction.

10. The laundry treating apparatus of claim 9, wherein the fifth wall is connected to a side face of the connection portion, and extends toward the rear face of the cabinet in a direction away from the side face of the connection portion.

11. The laundry treating apparatus of claim 1, wherein the ventilation hole has a lower end that faces the storage space and an upper end that faces the exterior of the detergent reservoir, and wherein a central portion of the ventilation hole between the lower end and the upper end of the ventilation hole extends in parallel with a top face of the detergent reservoir.

12. The laundry treating apparatus of claim 11, wherein the upper end of the ventilation hole extends from a first side of the central portion, and the lower end of the ventilation hole extends from a second side of the central portion that is opposite to the first side of the central portion.

13. The laundry treating apparatus of claim 12, wherein the central portion of the ventilation hole extends along a lateral direction of the detergent reservoir.

14. The laundry treating apparatus of claim 13, wherein the central portion, the upper end, and the lower end of the ventilation hole define an overlapping region that exposes the storage space to the exterior of the detergent reservoir.

15. The laundry treating apparatus of claim 1, wherein the ventilation hole is defined at a top surface of the detergent reservoir.

16. The laundry treating apparatus of claim 11, wherein the ventilation hole is located closer to a first side face of the detergent reservoir than to a second side face of the detergent reservoir opposite to the first side face of the detergent reservoir, wherein the plurality of the walls further includes a second wall located at an opposite side of the first side face with respect to the ventilation hole, wherein the second wall extends in the first direction, and wherein the ventilation hole is located between the first side face of the detergent reservoir and the second wall.

17. The laundry treating apparatus of claim 16, wherein the first wall is connected to the first side face of the detergent reservoir and the second wall is connected to the front face of the detergent reservoir, wherein the first wall and the second wall define an edge region in which the ventilation hole is located in the storage space.

18. The laundry treating apparatus of claim 9, wherein the fifth wall is connected to a side face of the connection portion, and extends rearward in a direction away from the side face of the connection portion.

* * * * *